United States Patent [19]

Shibusawa et al.

[11] 4,391,508

[45] Jul. 5, 1983

[54] COUNTER AND TIMING MECHANISM FOR COPYING APPARATUS

[75] Inventors: Mitsuo Shibusawa; Toshiyuki Ogawa, both of Tokyo, Japan

[73] Assignee: Ricoh Company, Ltd., Tokyo, Japan

[21] Appl. No.: 329,980

[22] Filed: Dec. 11, 1981

[30] Foreign Application Priority Data

Dec. 18, 1980 [JP] Japan ..... 55-178083

[51] Int. Cl.[3] ..... G03G 15/00

[52] U.S. Cl. ..... 355/14 CU; 355/14 R; 355/14 C

[58] Field of Search ..... 355/14 CU, 14 R, 8, 355/10, 14 C, 3 R

[56] References Cited

U.S. PATENT DOCUMENTS 4,099,860 7/1978 Connin ..... 355/14 C
4,124,289 11/1978 Miyata et al. ..... 355/8 X
4,183,660 1/1980 Bujese ..... 355/14 R X
4,315,685 2/1982 Inuzuka et al. ..... 355/14 R

*Primary Examiner*—A. C. Prescott
*Attorney, Agent, or Firm*—David G. Alexander

[57] ABSTRACT

A copying machine permits a desired number of copies to be set therein even in a warm-up period after a power switch is turned on, and starts the operation of a timer after a first display unit displays a copy ready condition. When a manual sheet feed switch is turned on, the entry of a desired copy number is inhibited. When the manual sheet feed switch is turned on after the entry of a desired copy number, a second display unit is loaded with a numerical value "1", the copy number is stored in a memory, and the timer is disenabled. As the manual sheet feed switch is turned off again, the preset copy number stored in the memory is indicated by the second display and the timer is activated.

6 Claims, 49 Drawing Figures

BPC0
BPC1
BPC2
BPC3
KS0
KS4
KS8
KSP
D751
D752
D753
D754
BA0
KS1
KS5
KS9
DSF
D755
D755
D756
D757
BA1
KS2
KS6
KSR
DSM
D758
D759
D760
D761
BA2
KS3
KS7
KSC
D762
D763
D764
BA3
CAM
MF
D765
D766
BB0
SHP
TCS
D767
D768
BB1
KCS
R316
BKCS
D769
BB2
JK
MCS
STY
D770
D771
D772
BB3

| Fig. 45a |
|---|
| Fig. 45b |

COUNTER AND TIMING MECHANISM FOR COPYING APPARATUS

BACKGROUND OF THE INVENTION

The present invention generally relates to copying apparatuses and, more particularly, to a copying apparatus of the type which prevents a desired preset number of copies from being cleared by the operation of a timer but when needed.

In a copying apparatus having a heat type fixing unit, a desired number of copies can be loaded therein in a warm-up condition of the apparatus. However, when a timer is operated after a desired copy number has been set in a warm-up period, the copy number will be cleared if the warm-up period is relatively long.

SUMMARY OF THE INVENTION

A characteristic feature of the present invention resides in that such a drawback inherent in the prior copying apparatus is eliminated by permitting a selected copy number to be designated even in the warm-up period after a power switch is turned on and by starting the operation of a timer after a display unit displays a copy ready condition.

It is accordingly an object of the present invention to provide a copying apparatus which inhibits the operation of a timer as when a sheet jam occurs in the apparatus, when a clear/stop key is turned on to interrupt a copying operation or when the operation of the apparatus is stopped due to the absence of paper sheets, thereby holding a preloaded desired number of copies and affording an improved operationability.

It is another object of the present invention to provide a generally improved copying apparatus.

Other objects, together with the foregoing, are attained in the embodiment described in the following description and illustrated in the accompanying drawings. DR

BRIEF DESCRIPTION OF THE DRAWINGS

FIG. 15(*b*) is a diagram of a wave shaping circuit in accordance with the present invention;

DESCRIPTION OF THE PREFERRED EMBODIMENTS

While the copying apparatus of the present invention is susceptible of numerous physical embodiments, depending upon the environment and requirement of use, substantial numbers of the herein shown and described embodiment have been made, tested and used, and all have performed in an eminently satisfactory manner.

Figure 1:
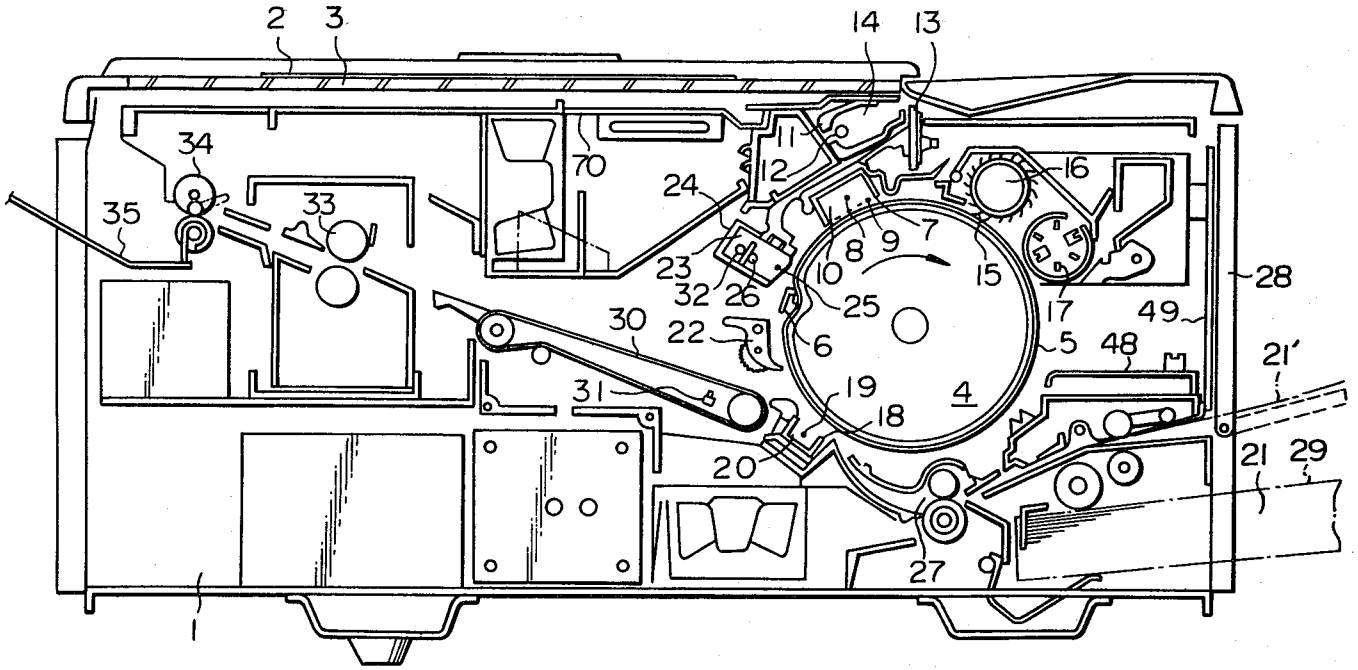
FIG. 1 is a side elevation of a copying apparatus embodying the present invention.

Referring to FIG. 1 of the drawings, the copying apparatus includes a housing 1, a platen 3 mounted on top of the housing to move along a horizontal path while carrying an original document 2, and a drum 4 accommodated within the housing 1 to rotate in a predetermined direction. A photoconductive member 5 in the form of a replaceable sheet is wound on and secured to the drum 4 by means of a clamp device 6. Various units are arranged around the photoconductive member 5 on the drum 4 and individually operated to complete a copying cycle for about two full rotations of the drum 4. Disposed above the drum 4 is a charging unit 10 which comprises a shield case 7, a charge wire 8 and a grid 9 to charge the photoconductive member 5 during the first rotation of two successive rotations of the drum 4. A voltage stabilizing element (not shown) is electrically connected with the grid 9 so that a uniform charge distribution is set up on the photoconductive member 5.

Located above the charger 10 is an exposing unit 14 which is made up of a reflector 11, a lamp 12 and a condensing optical element 13. During the first rotation of the drum 4, the exposing unit 14 illuminates the document 2 on the platen 3 through a slit to form a latent image electrostatically on the photoconductor 5. An auxiliary cleaning unit 16, a developing and cleaning unit 17, a charger 20 for image transfer, a sheet separator 22 and a residual charge removing unit 23 are also arranged around the drum 4 successively along the direction of drum rotation indicated by an arrow in the drawing. The auxiliary cleaning unit 16 has a rotary brush 15 which is disengaged from the photoconductive member 5 during the first rotation of the drum 4 and engaged therewith during the second rotation to clean the surface of the photoconductor 5. The developing and cleaning unit 17 deposites a toner on a latent image on the photoconductor 5 during the first rotation of the drum 4 and removes residual particles of the toner from the photoconductor 5 during the second rotation. A vibration type detector for detecting a residual amount of the toner (not shown) is positioned adjacent to the developing and cleaning unit 17. The charger 20 comprises a shield case 18 and a corona wire 19 and operates to transfer the toner image from the photosensitive drum 5 to a sheet of paper 21 during the first rotation of the drum 4. The separator 22 is adapted to separate the paper sheet 21 which is electrostatically adhered to the photoconductor 5. The residual charge removing unit 23 is made up of a shield case 24, a charge wire 25 and a lamp 26. The unit 23 is constructed such that charging occurs throughout the first and second rotations of the drum 4 while the lamp 26 is energized in the second rotation only thereby expelling a residual charge on the photoconductive member 5.

In the illustrated copying apparatus, a paper sheet can be selectively fed from a sheet cassette 29 and an openable manual insertion door or table 28. A sheet feed device 27 is positioned below the drum 4 to feed a paper sheet to a transfer station between the photoconductor 5 and the transfer charger 20. When the manual insertion door 28 is closed as indicated by a solid line in the drawing, the sheet feed device 27 will feed a stack of paper sheets 21 one by one to the transfer station between the photoconductor 5 and the transfer charger 20. Likewise, then a paper sheet 21' is introduced manually into the copying apparatus along the door 28 which will then be opened as indicated by a phantom line to serve as a table, the sheet feed device 27 will feed the paper sheet 21' to the transfer station.

A conveyor belt 30 is situated below the separator 22 to move a transfer sheet 21 which is separated from the photoconductive member 5 by the separator 22. A sensor 31 is positioned between the upper and lower runs of the conveyor belt 30 in order to determine whether the transfer sheet 21 has been separated from the photoconductive member 5. A light source 32 is disposed in the residual charge removing unit 23 to emit sensing light to the sensor 31. Further, a fixing unit 33 for fixing a toner image on the paper sheet 21 and a sheet discharging unit 34 are located one after the other in alignment with the sheet feed path on the conveyor 30. The paper sheet 21 or 21' having the toner image is driven by the discharging unit 34 onto a tray 35.

Figure 2:
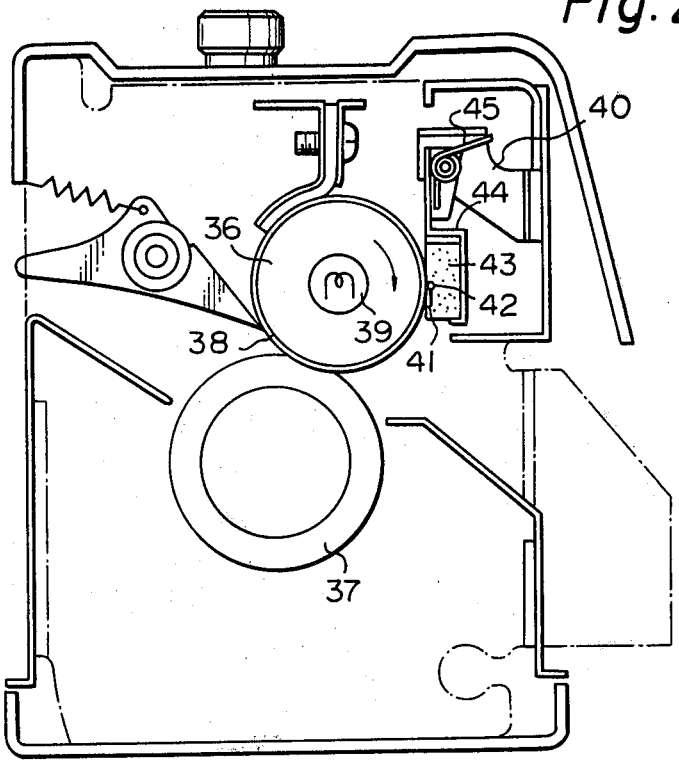
FIG. 2 is a side elevation of a fixing unit included in the copying apparatus.
Figure 3:
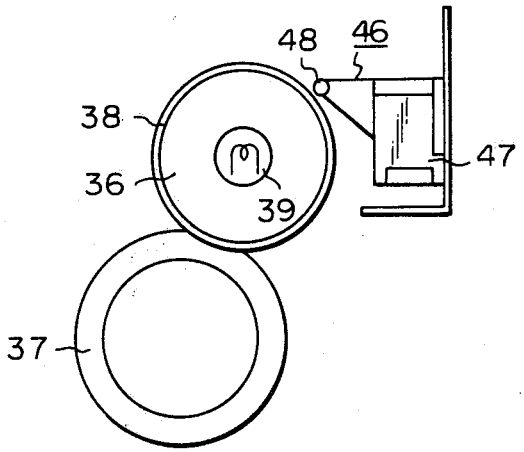
FIG. 3 is a fragmentary side elevation of the fixing unit.

Details of the fixing unit 33 are illustrated in FIG. 2. The fixing unit 33 comprises a heat roller 36 and a silicone roller 37. The heat roller 36 consists of a pipe 38 made of stainless steel and a heater element 39 located inside the pipe 38. The surface temperature of the heat roller 36 is controlled constantly to about 190° C. by a temperature sensor assembly 40. In the sensor assembly 40, a thermistor 42 is arranged on a flexible printed circuit board 41 and held in pressing contact with the heat roller 36 by a pressing and supporting member made up of a sponge 43, a support 44 and a spring 45. As viewed in FIG. 3, the fixing unit 33 also includes an excessive temperature elevation preventing device 46 which comprises a support 47 and a temperature fuse 48 and neighbors the heat roller 36.

Figure 4:
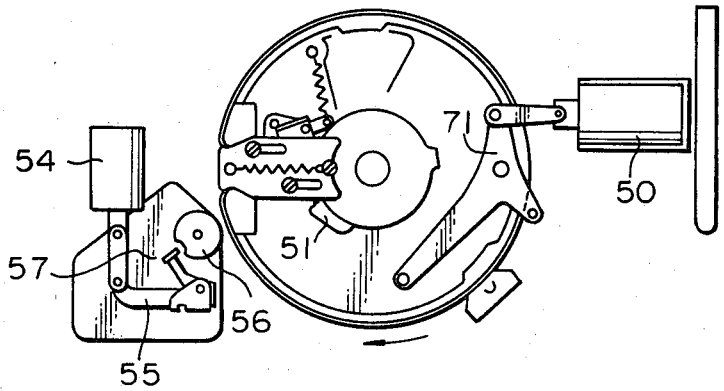
FIG. 4 is a side elevation of a photoconductor replacing device in accordance with the present invention.
Figure 5:
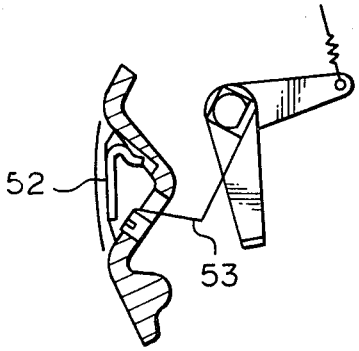
FIG. 5 is a fragmentary side elevation of the photoconductor replacing device.

In FIG. 1, a device 48 for the replacement of the photoconductive member 5 is positioned below the developing and cleaning unit 17. With this device 48, the photoconductor 5 can be replaced with fresh one by approximately three full rotations of the drum 4. For the replacement, the manual insertion door 28 is opened and then a cover 49 is removed from the housing 1. Under this condition, a replacement switch (not shown) is turned on so that the drum 4 is rotated in a predetermined direction as shown in FIG. 4 and a solenoid 50 is retracted to start discharging the photoconductive member 5. A clamper actuating cam 51 provided to the drum 4 moves a trailing end clamper 52 and a leading end clamper 53 (see FIG. 5) to unclamp the photoconductor 5. Upon approximately one and a half rotations, the drum 4 is stopped by a drum stop device 57 which has a drum stop solenoid 54, a clutch release lever 55 and a drum stop cam clutch 56. Then, the photoconductor 5 can be taken out from the housing 1. After the removal of the used photoconductor 5, a fresh photoconductor 5 is clamped by the leading end clamper 53 and the replacement switch is turned on again. This causes the drum 4 into rotation in the same direction as in the discharging action to wind the new member 5 on the drum 4, the trailing end of the member 5 being clamped by the trailing end clamper 52.

Hereinafter will be described the foregoing copying process which is controlled by a microcomputer by way of example.

Figure 6:
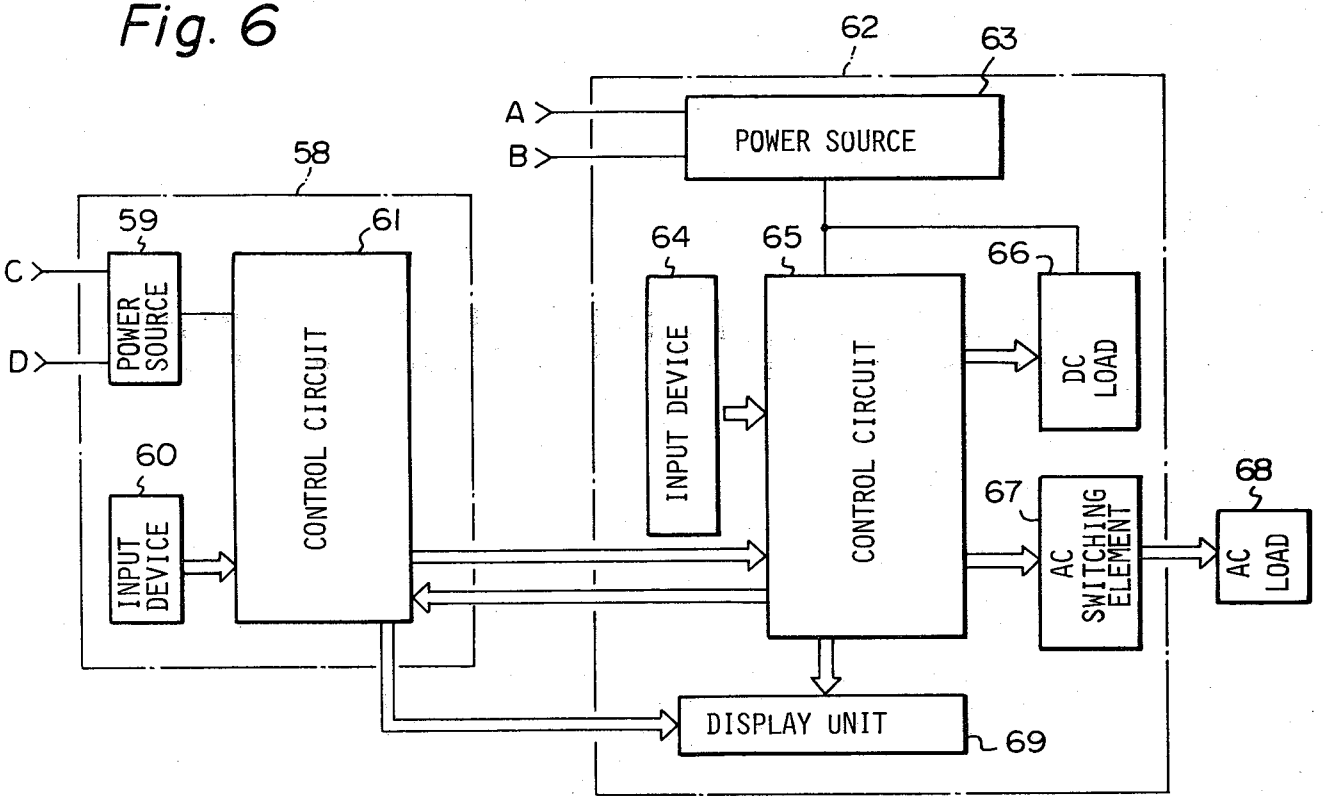
FIG. 6 is a block diagram showing a control system associated with the copying apparatus.

Referring to FIG. 6, a control system for the copying apparatus 1 of FIG. 1 is generally made up of a first control unit 58 and a second control unit 62. The first control unit 58 comprises a power source device 59, an input device 60 and a control circuit 61. The second control unit 62 comprises a power source device 63, an input device 64, a control circuit 65, a d.c. load 66, an a.c. switching element 67, an a.c. load 68 and a display unit 69.

Figure 7:
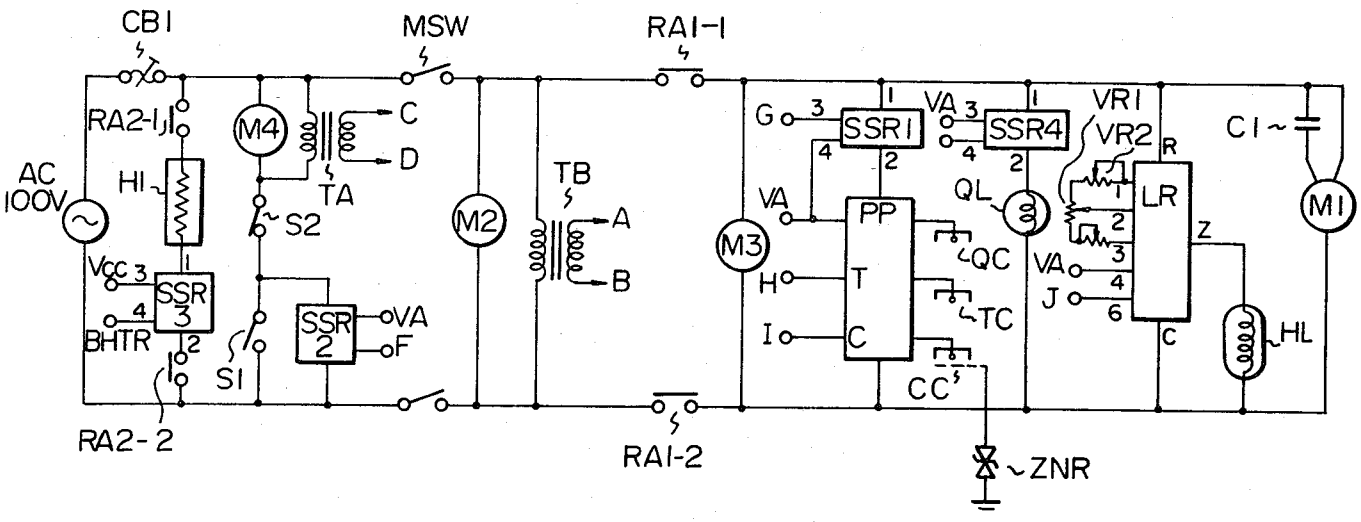
FIG. 7 is a diagram showing a detailed arrangement of the control system indicated in FIG. 6.

FIG. 7 illustrates a control circuit associated with the copying apparatus 1 of FIG. 1. The entire copying apparatus 1 is driven by a drive motor M1. A composite high tension power source PP consists of a first high tension power source CC for charging the photoconductor 5 to a predetermined surface potential, a second high tension power source TC for transferring a toner image from the photoconductor 5 to the paper sheet 21, and a third high tension power source QC for removing a residual potential from the photoconductor 5 after the transfer of the toner image in order to facilitate the subsequent cleaning operation. The composite high tension power source PP is energized by an a.c. switching element SSR1. The discharging lamp QL is energized by a second a.c. switching element SSR4. These a.c. switching elements SSR1, SSR4 are individually controlled by their trigger inputs (terminals no. 4). The high tension power sources CC, TC are individually controlled by trigger inputs TRC, TRT. A control unit LR is adapted to stabilize the voltage coupled to the exposing lamp HL while varying the same voltage to control the amount of exposure. The control unit LR is controlled by a trigger input (terminal no. 6). The output voltage of the control unit LR can be varied by exposure amount varying means which comprises first and second light control devices VR1, VR2. The first light control device VR1 is mounted on the control panel of the copier while the second light control device VR2 is disposed in the copier (outside the region for manipulation) for the compensation of an exposure width set by the light control device VR1. A motor M3 is located in the vicinity of the exposing unit 14 with the lamp HL for the purpose of cooling the platen 3 and its neighborhood.

A power relay RA1 has contacts RA1-1, RA1-2 which turn on and off both of the hot and neutral lines of a commercial power supply to thereby turn on and off the drive motor M1, composite high tension power source PP, discharging lamp QL, exposing lamp HL, control unit LR and cooling motor M3. A vacuum fan M2 is provided to suck air from below the sheet feed path of the conveyor 30 and discharge it to the outside of the housing 1, ensuring positive conveyance of a paper sheet under suction. A transformer TB is adapted to supply power to the control unit 62 (see FIG. 6) and the like which control the copying sequence. The hot and neutral lines of the commercial power supply are turned on and off by a main switch MSW. A heat source or heater H1 is included in the fixing unit to fuse a toner image on a paper sheet by application of heat. The heater H1 is in the form of a halogen lamp in the illustrated embodiment. The heater H1 is energized by an a.c. switching element SSR3 which is in turn triggered by an trigger input 4. The heater H1 and switching element SSR3 are turned on and off by a power relay RA2 which has contacts RA2-1, RA2-2 to turn on and off the hot and neutral lines of the commercial power supply. The first control unit 58 exchanging signals with the second 62 to control the a.c. switching element SSR3 is powered by a transformer TA. The transformer TA is connected with a preheat switch S1 via a door switch S2. An a.c. switching element SSR2 is connected in parallel with the preheat switch S1. A second cooling fan M4 is connected in parallel with the transformer TA to cool the atmosphere inside the housing 1. The control units 58 and 62 are connected with each other.

Figure 8:
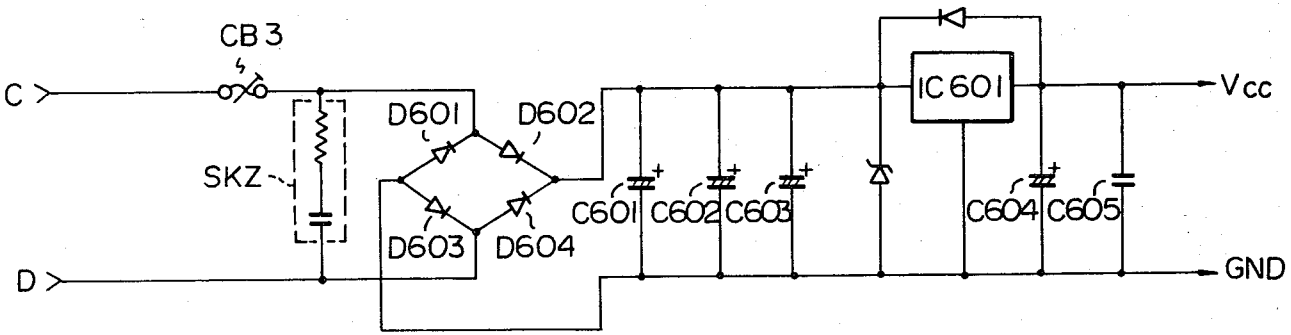
FIGS. 8–11*b* are diagrams of a control unit 58 forming part of the control system.
Figure 9:
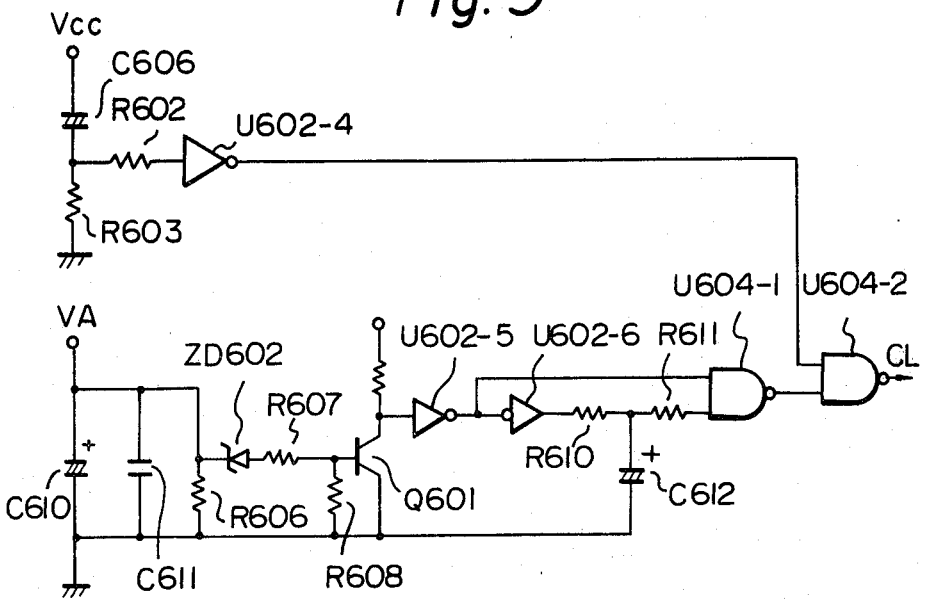
Figure 10:
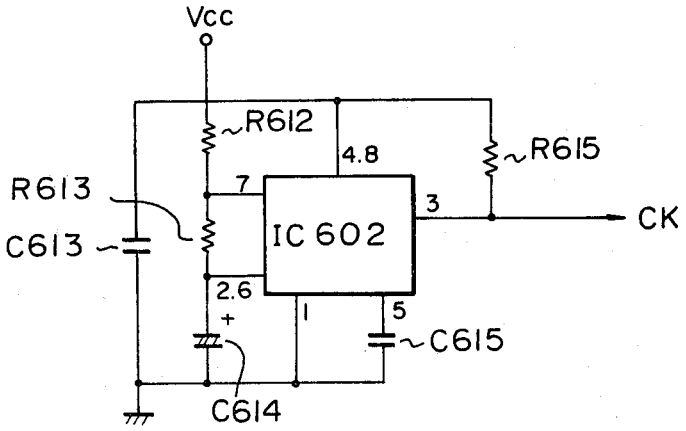

Reference will now be made to FIGS. 8–21 for describing the details of the control system. The first control unit 58 shown in FIG. 6 is indicated in detail in FIGS. 8–11. The control unit 58 includes a power source circuit indicated in FIG. 8 which is connected with a power source Vcc of FIGS. 9–10, display light emitting diodes LED of FIG. 22 and a power source Vcc for preheat display PH which will be described. FIG. 10 indicates a control circuit for controlling the heater H1 and which comprises a C-MOS. FIG. 9 shows an initial reset circuit and FIG. 10 a clock oscillation circuit.

In FIG. 7, the heater H1 can be driven even though the main switch MSW is kept turned off. In detail, when the preheat switch S1 is in its on state, the door switch S2 normally remains on so that the transformer TA is supplied with a voltage to actuate the control unit 58. Even if the preheat switch S1 is off, a d.c. power source VA will be turned on as will be described only if the main switch MSW is closed, whereby the a.c. switching element SSR2 connected in parallel with the preheat switch S1 will be turned on to energize the transformer TA and thereby the control unit 58.

Suppose that the main switch MSW is off and the preheat switch S2 is on. Under this condition, the power source Vcc is turned on so that an inverter U602-4 in FIG. 9 maintains a low or "L" output for a given period of time. This allows a NAND gate U604-2 to maintain its output CL at a high or "H" level for a given period of time. Consequently, in FIG. 11, a D type flip-flop D-FF and J-K flip-flop JK-FF hold their outputs Q at low or "L" level and output $\bar{Q}$ at a high or "H" level, setting up an initial reset condition.

Figure 11A:
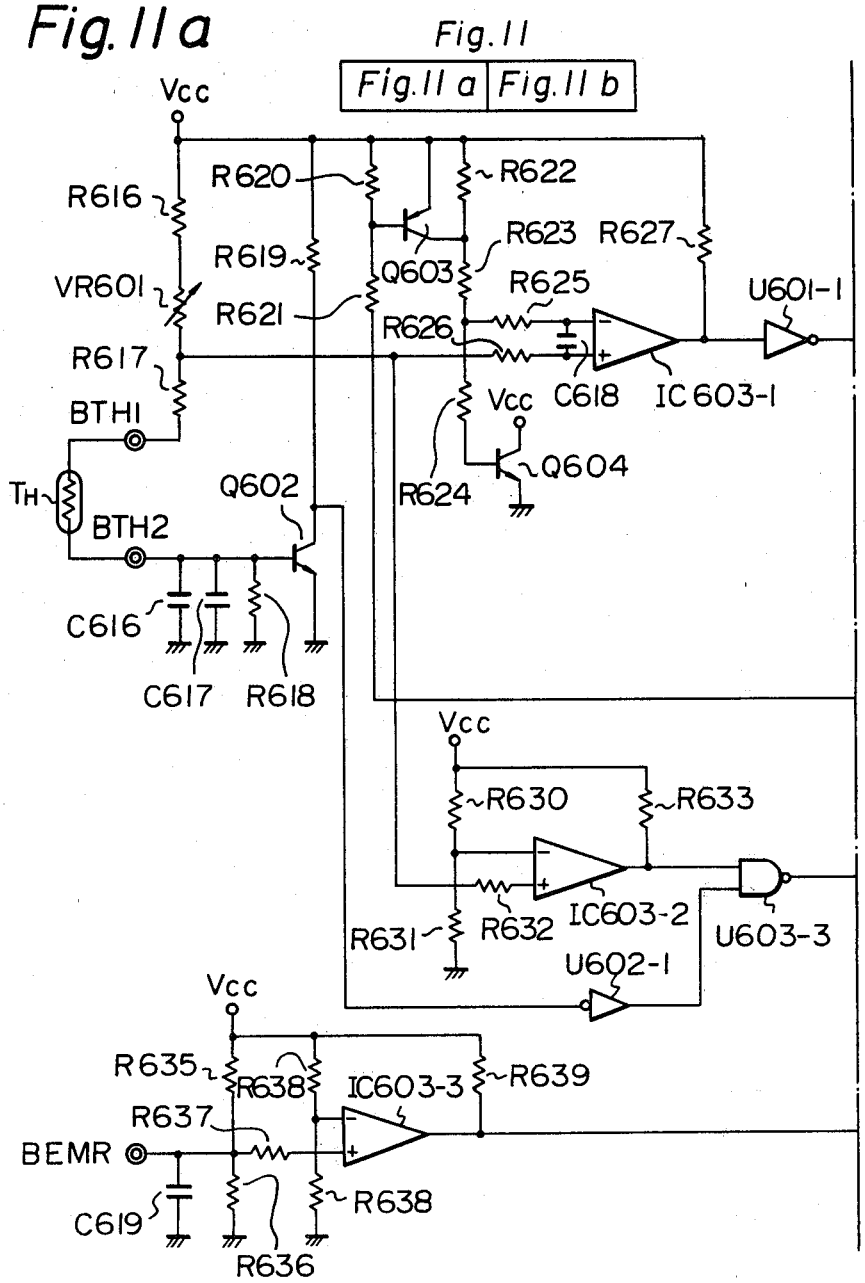
Figure 11B:
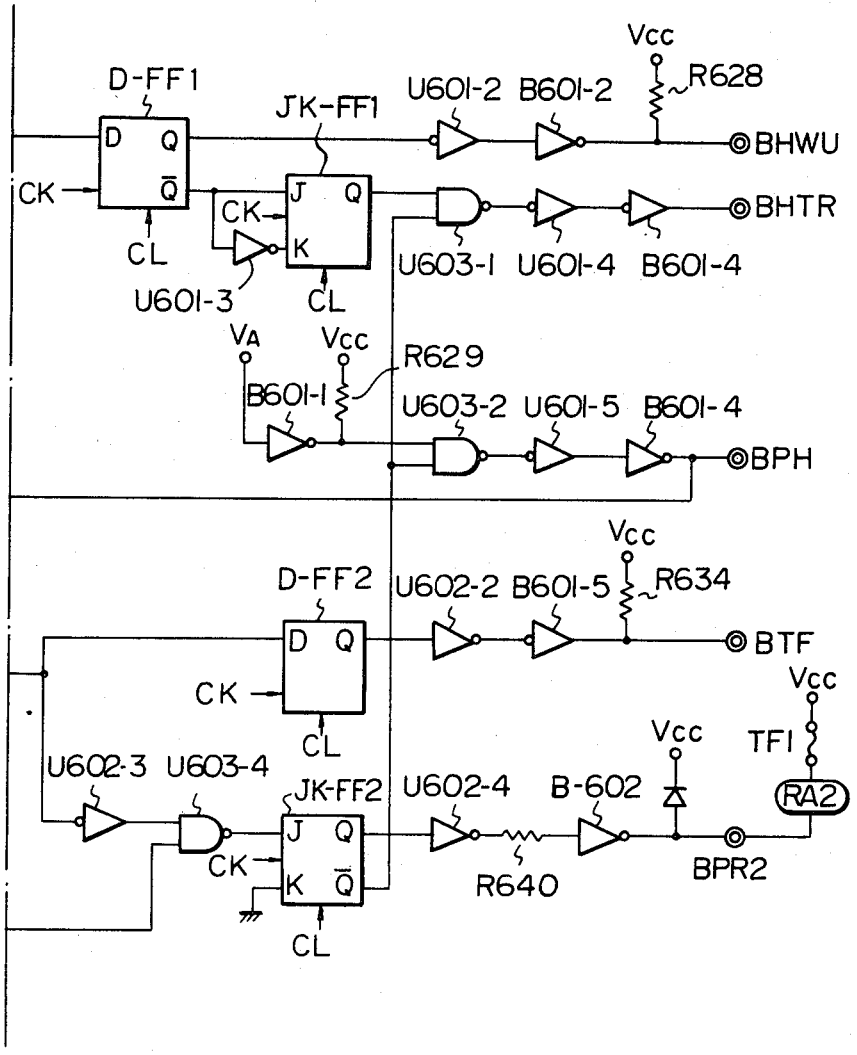

In FIG. 11, the thermistor 41 of FIG. 2 is connected with terminals BTH1, BTH2. The control unit 62 of FIG. 6 is connected with a terminal BEMR which is normally open but becomes low or "L" level upon failure of the control unit 62. A terminal BHWU is also connected with the control unit 62 and maintains its level "L" normally but "H" upon elevation of the temperature of the heater H1 to a desired level. A terminal BTHR is connected to the trigger terminal of the a.c. switching element SSR3 (see FIG. 7) so as to turn on and off the element SSR3 by its "L" and "H" outputs, respectively. A terminal BPH is connected to the light emitting diodes LED of the display on the control panel to provide a preheat display when the preheat switch S2 is closed and the main switch MSW is opened. A terminal BTF is connected to the control unit 62 and normally maintains its level "L" but makes it "H" upon failure of the control unit 58. Further, a terminal BPR2 is connected to the temperature fuse TF1 through the power relay RA2 and therethrough to the power source Vcc.

Operation of the circuitry of FIG. 11 will be described supposing that the main switch MSW is open. In this situation, the d.c. power source VA is turned off as will be described so that an inverter B601-1 is supplied with a low or "L" input to make the output level of a driver B601-4 low or "L", thereby turning on the preheat display LEDPH shown in FIG. 21. The driver B601-4 turns on a transistor Q603 which is connected through a resistor R621 to the driver B601-4. Thus, the input to an inverting input terminal of a comparator IC603-1 is set at $$V_- = \frac{R624}{R622 + R623 + R624} \times Vcc.$$

The resistance RTH of the thermistor TH remains relatively high at normal temperatures. Hence, the input to the non-inverting input terminal of the comparator IC603-1 is approximately $$V_+ = \frac{RTH + R617}{R616 + R617 + VR601 + RTH} \times Vcc.$$

Since $V_- < V_+$, the output level of the comparator IC603-1 becomes "H" making the output Q of the flip-flop D-FF1 "L" level and the output $\bar{Q}$ "H" level. This turns the Q output of the J-K flip-flop (used here as the D type) to "H" level to trigger the switching element SSR3 which is connected with the terminal BTHR, thereby turning on the heater H1. As long as the control unit 58 is in a normal operating condition, the Q output of the J-K flip-flop JK-FF2 is "L" level to maintain the power relay RA2 turned on, that is, energize its contacts RA-1, RA-2. As the temperature of the heat roller 36 rises to a predetermined level, the resistance RTH of the thermistor TH is lowered from the initial value. When the inputs to the inverting and non-inverting input terminals $V_-$ and $V_+$ of the comparator IC603-1 are brought into a relation $V_- > V_+$, the output of the comparator is inverted to open the terminal BHTR. Then, the trigger input to the a.c. switching element SSR3 disappears to deenergize the heater H1. Thereafter, such a procedure is repeated for any variation in the temperature of the heat roller 36 to control the roller temperature to a predetermined level. This predetermined temperature will be referred to as a first reference temperature.

Now, when the main switch MSW is closed with the preheat switch S2 kept closed, the d.c. power source VA is turned on as will be described to make the input to an inverter B601-1 "H" level and thereby the terminal BPH "H" level. This causes the preheat display LEDPH to disappear. At the same time, the transistor Q603 is rendered non-conductive to vary the preset value of the input $V_-$ to the inverting input terminal of the comparator IC603-1 as expressed by $$V_- = \frac{R624}{R622 + R623 + R624} \times Vcc.$$

This input is lower than the aforesaid input $V_-$ so that the output of the comparator IC603-1 becomes "L" level, whereby the heater H1 is energized and its temperature is controlled to a second reference temperature which is higher than the first. In this manner, the heat roller 36 is controlled to a lower temperature during preheating operation (preheat switch S2 closed) to save power and prolong the service life of the parts concerned; this also minimizes the time period which the copier takes until it actually enables a copying cycle after closing the main switch MSW. During a preheating period, the preheating condition is displayed on the control panel to facilitate operator's recognition. Either one of the two different modes of operation can be selected by simple manipulation of the preheat switch S2. If the event of a failure during copying operation such as a sheet jam, the control unit 58 is supplies with a signal from the control unit 62 at its terminal BEMR. This signal turns off the terminals BHTR and BPR2 to deenergize the a.c. switching element SSR3 and power relay RA2, thereby ensuring safety manipulation for the removal of a jammed sheet or the like. Even if the main switch MSW is opened after the supply of a failure signal from the unit 62 to the unit 58, the a.c. switching element SSR3 and power relay RA2 remain deenergized because the failure signal is stored in the J-K flip-flop JK-FF1. The control unit 58 is designed to prevent the heater H1 from being kept energized due to breakage of the thermistor TH in three ways, which would otherwise lead to a fire. First, the temperature fuse TF1 is connected in series with the power relay RA2 and located in the vicinity of the heat roller 36 as previously mentioned, constituting the excessive temperature elevation preventing device 46. When disconnected, the temperature fuse TF1 deenergizes the power relay RA2 so that the power supply to the heater H1 is disconnected. Second, a comparator IC603-2 is provided to turn on the J-K flip-flop JK-FF2 and turn off the power relay RA2 when the resistance RTH of the thermistor JH is lowered to an unusual level (when the a.c. switching element SSR3 is not turned off even if the heat roller 36 is heated to a high level). Third, breakage of the thermistor TH is detected. In detail, since the base current of a transistor Q602 is supplied from the power source Vcc via the thermistor TH, breakage of the thermistor TH turns off the transistor Q602 to render the input of an inverter U602-1 "H" level. This again turns on the J-K flip-flop JK-FF2 to deenergize the power relay RA2. When the thermistor is broken, a signal indicating this condition is transmitted through the terminal BTF to the control unit 62. A signal is also supplied to the control unit 62 when the resistance of the thermistor TH is lowered to an unusual level (when the heat roller is heated to an unusual level).

It will be seen that, according to this embodiment, an operator can select a desired mode of operation through the main switch MSW and preheat switch S2.

Figure 12:
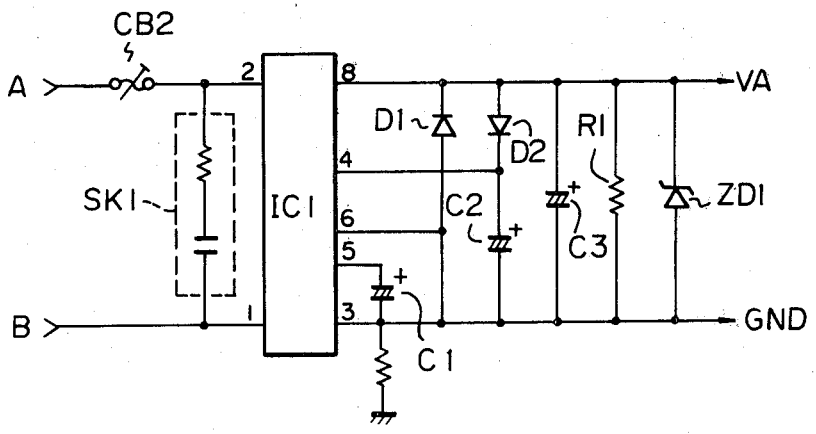
FIGS. 12 and 13 are diagrams of a power source device 63 included in the control system.
Figure 13:
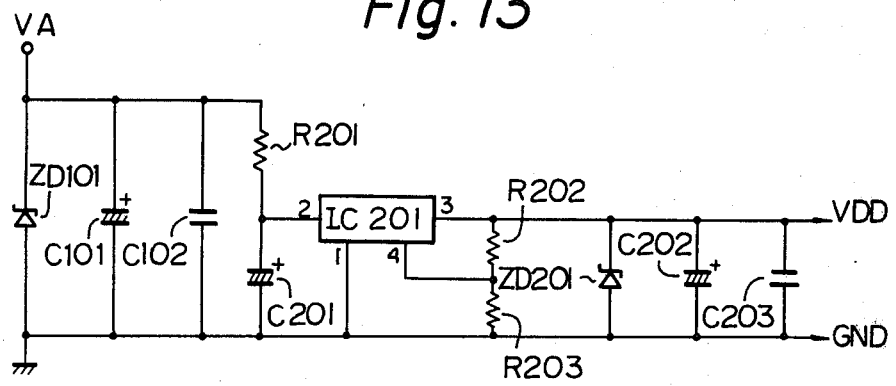
Figure 15A:
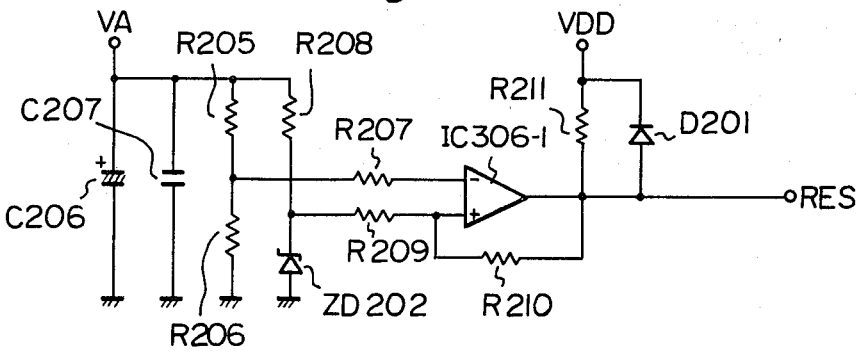
FIG. 15(*a*) is a diagram of a reset circuit in accordance with the present invention.
Figure 15B:
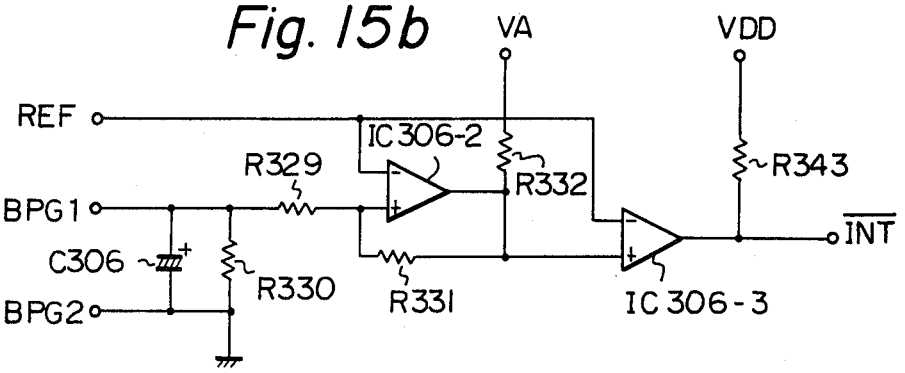
Figure 14:
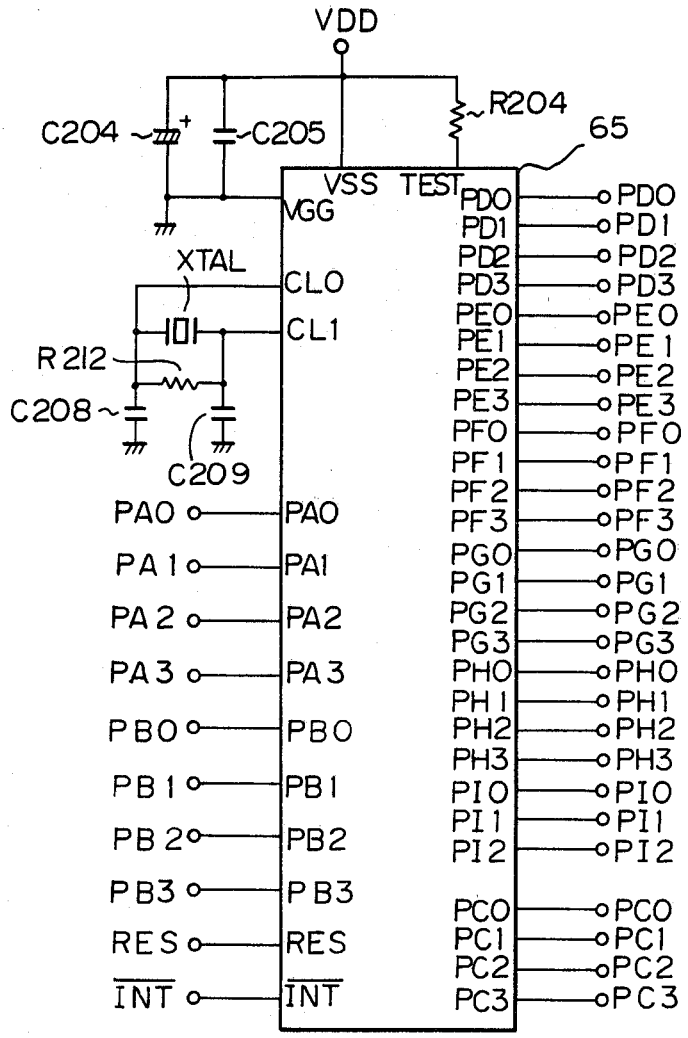
FIG. 14 is a diagram of a control circuit 65 also included in the control system.
Figure 24:
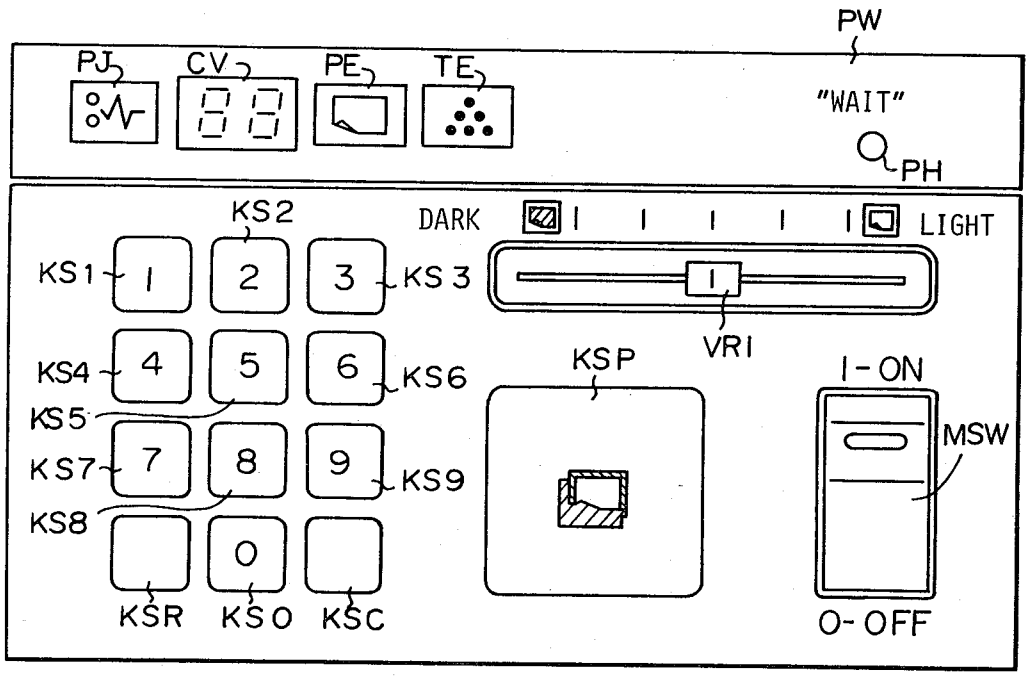
FIG. 24 is a front elevation of a control panel mounted on the copying apparatus of the invention.
Figure 25:
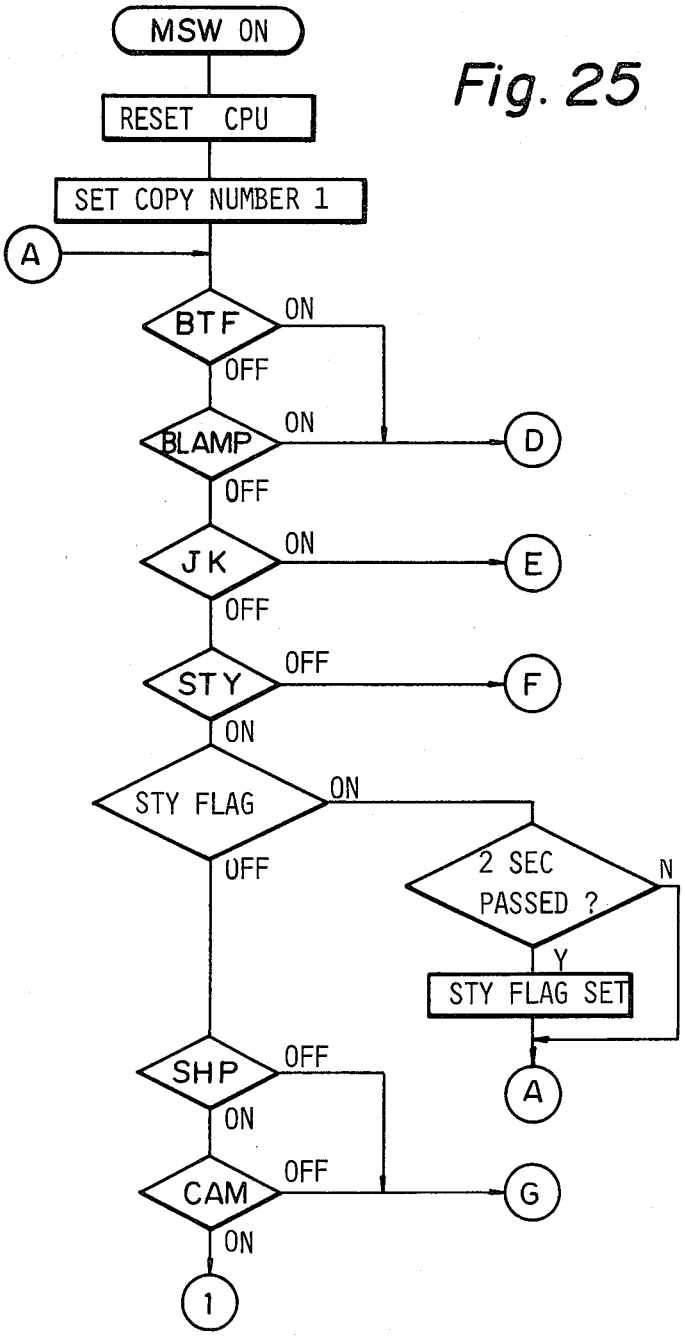
FIGS. 25–44 of flowcharts demonstrating a control of a copying operation performed by the copying apparatus.
Figure 26:
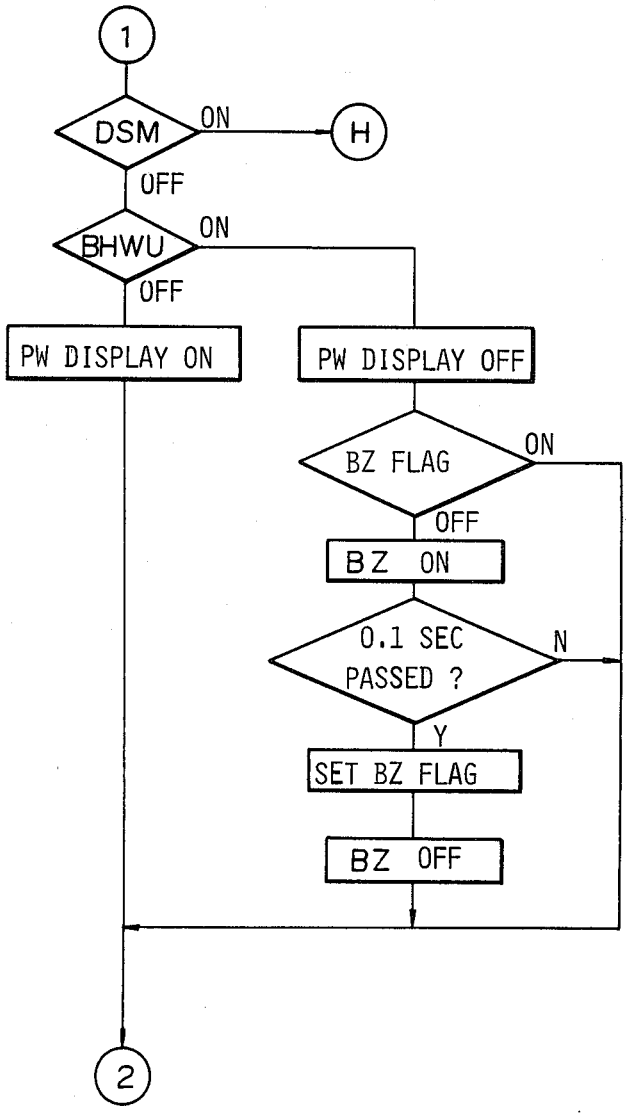
Figure 27:
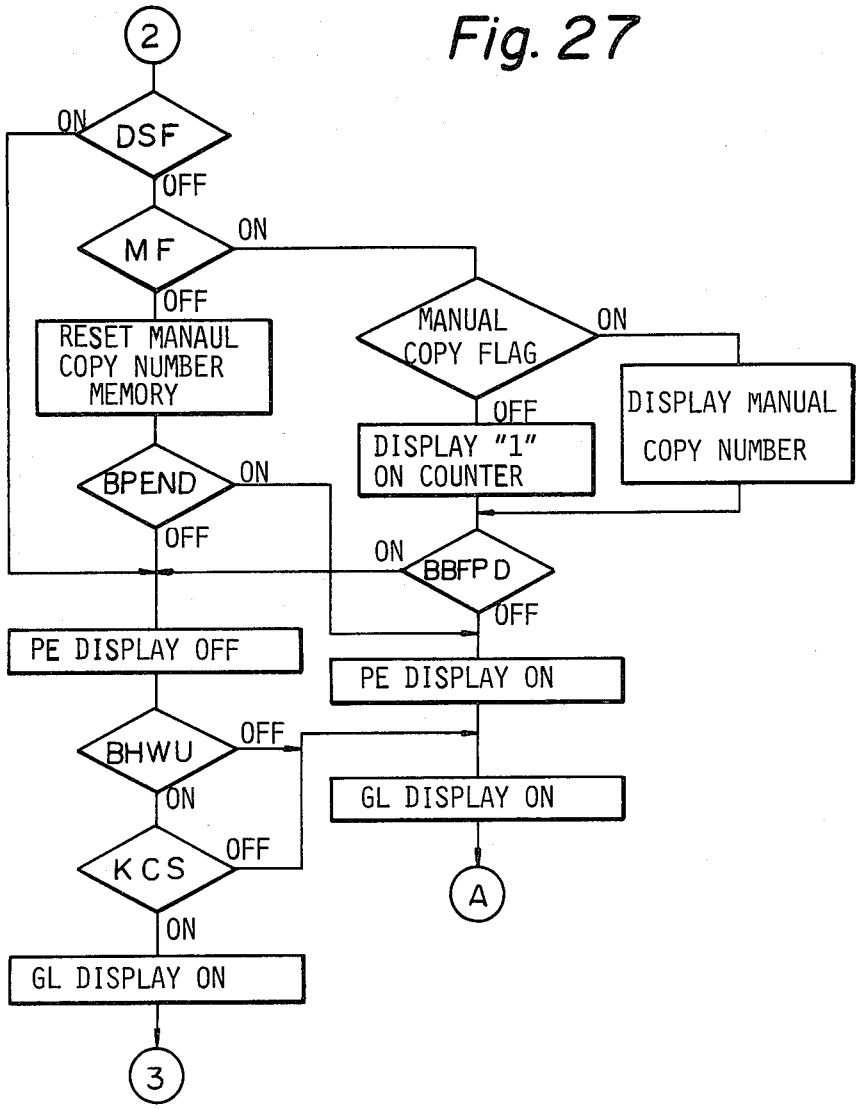
Figure 28:
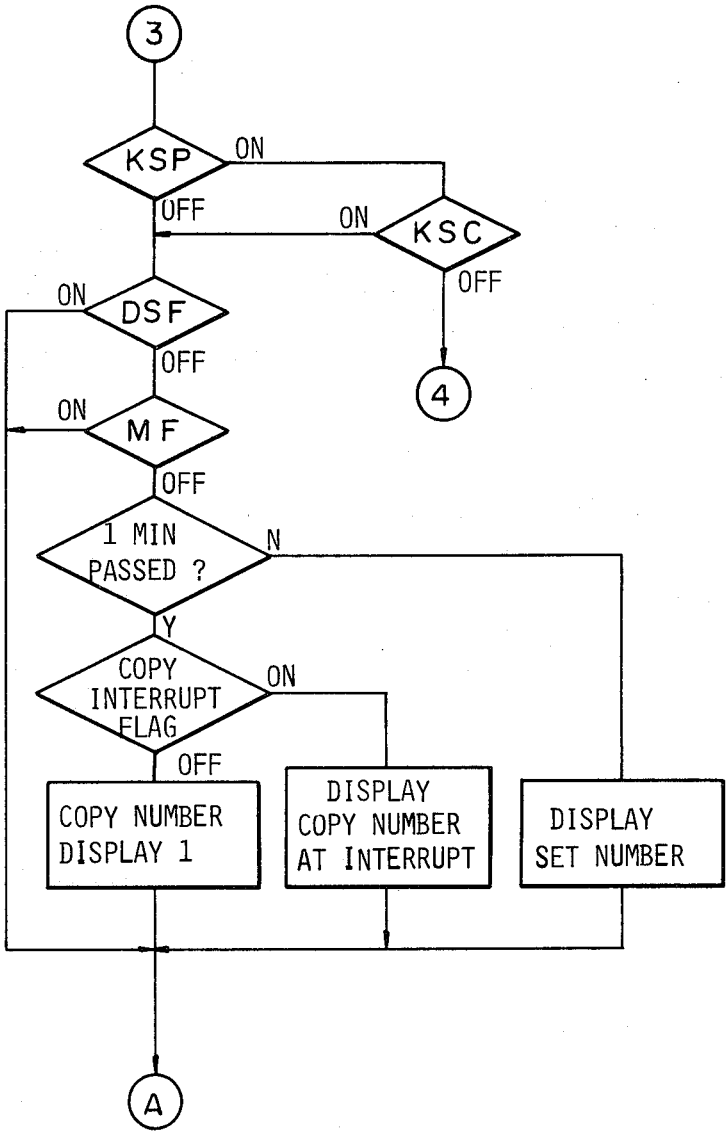
Figure 29:
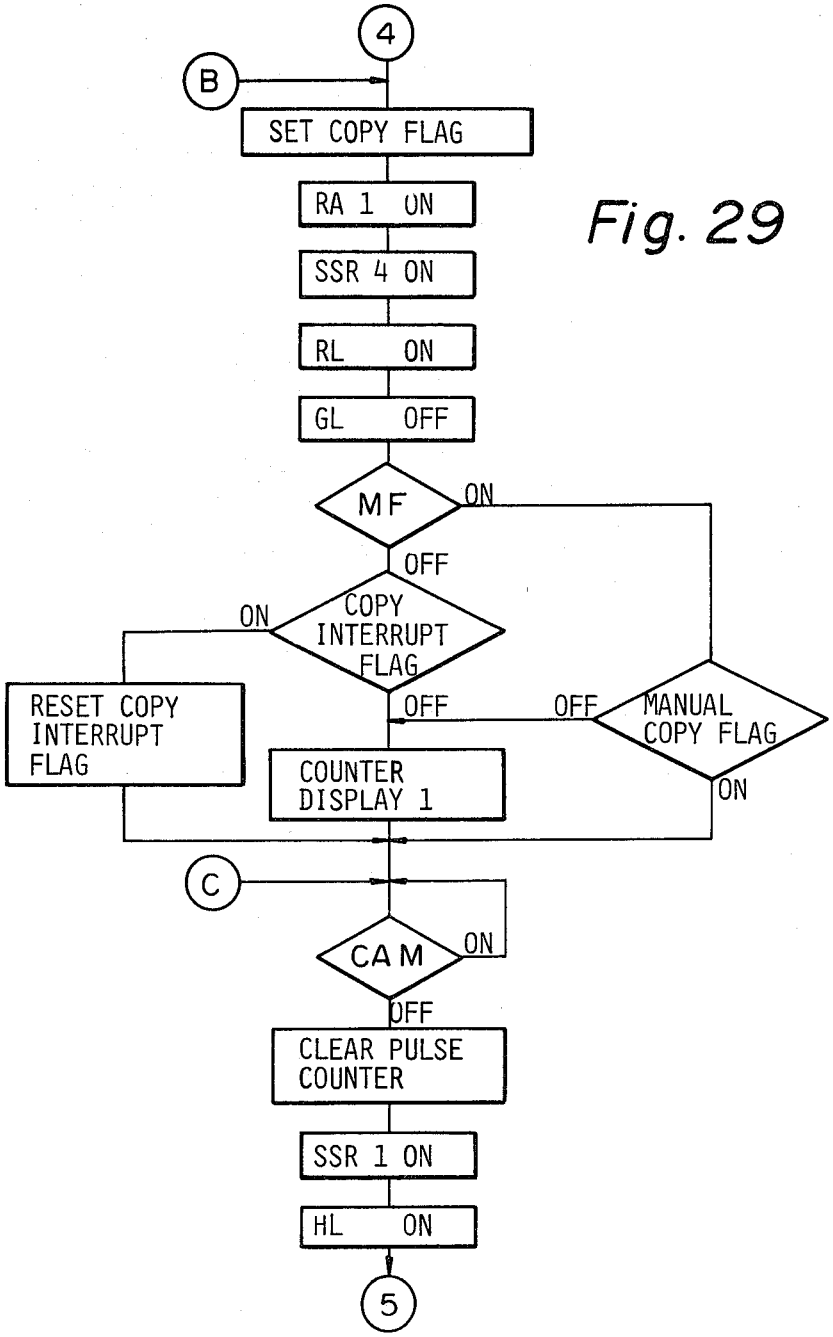
Figure 30:
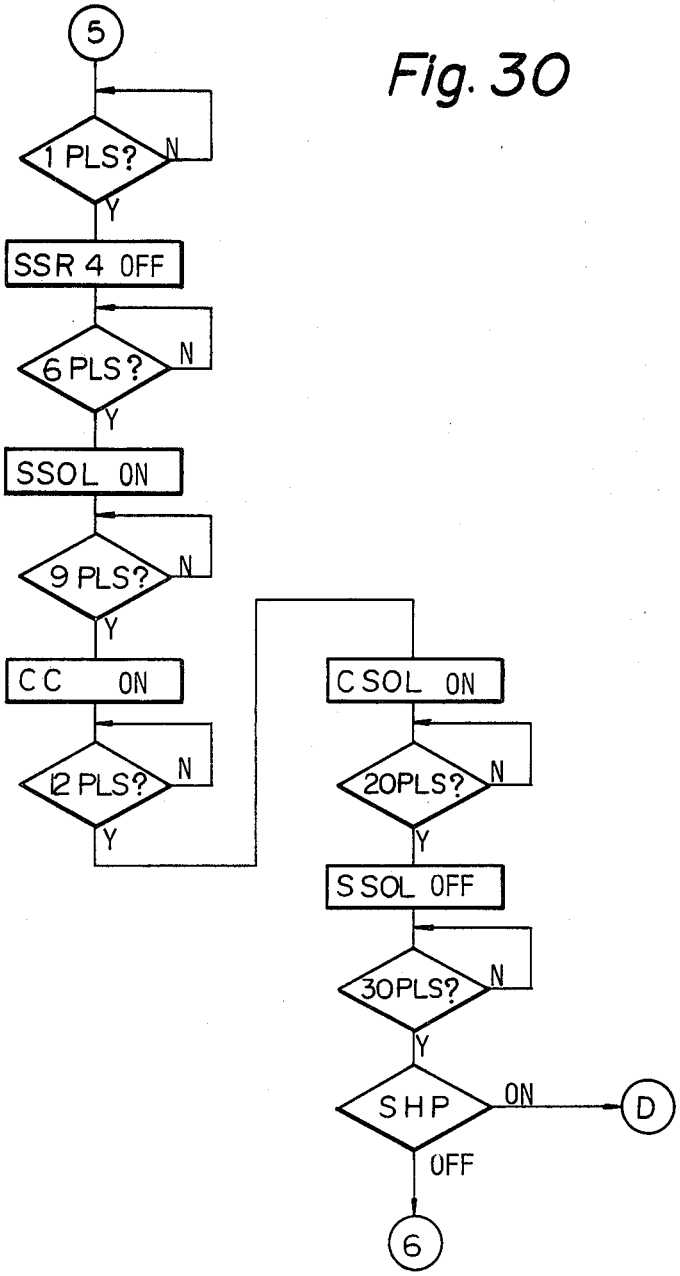
Figure 31:
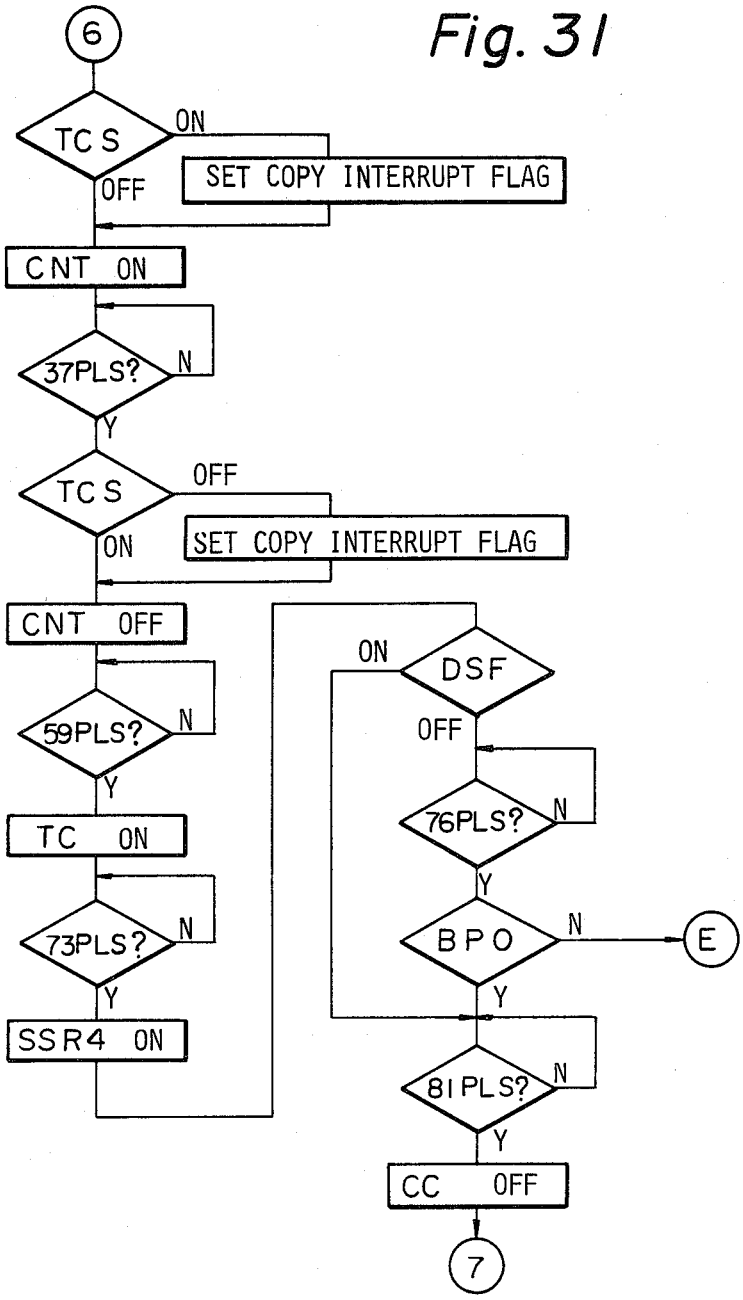
Figure 32:
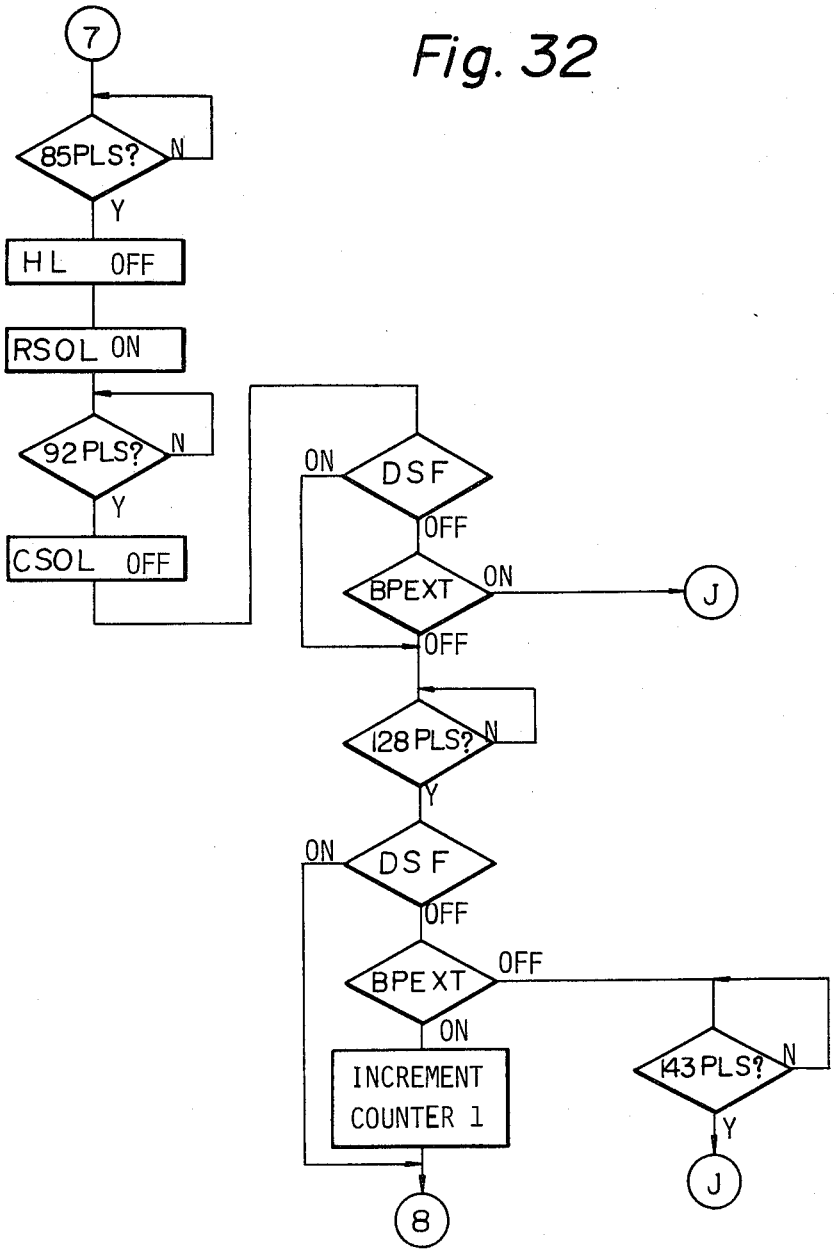
Figure 33:
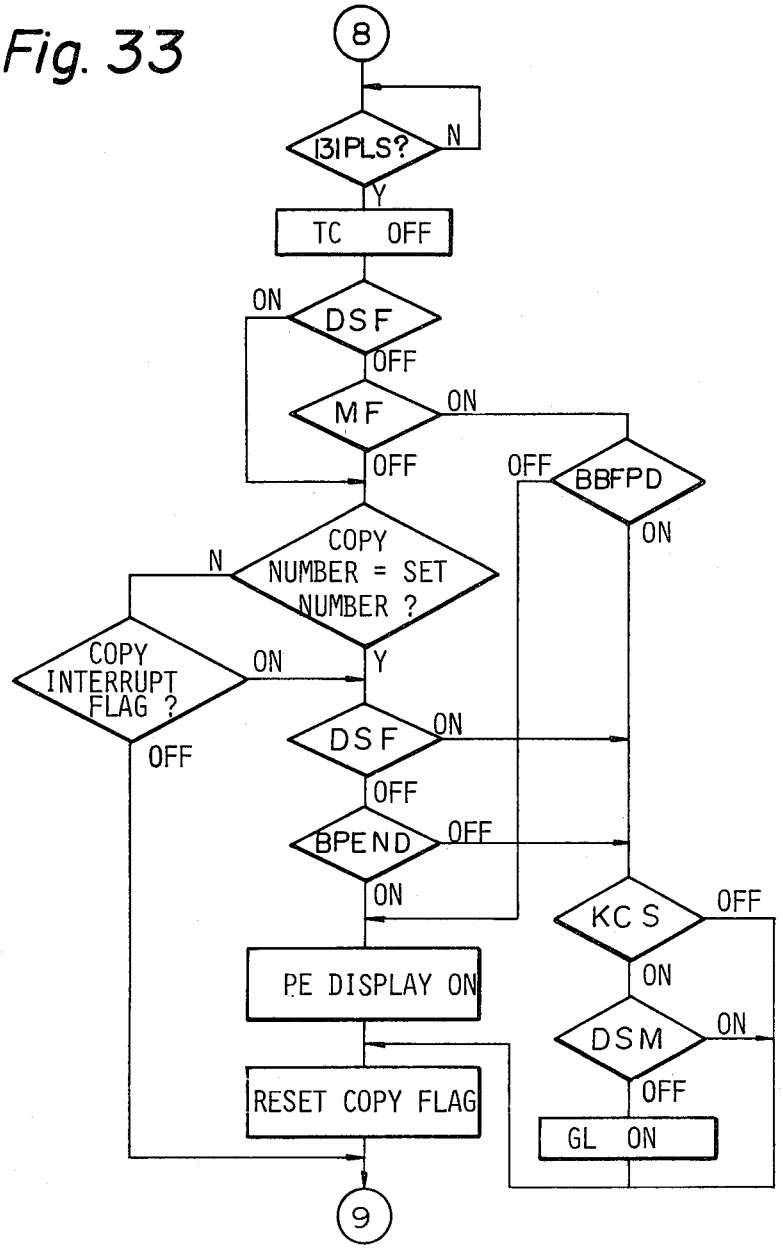
Figure 34:
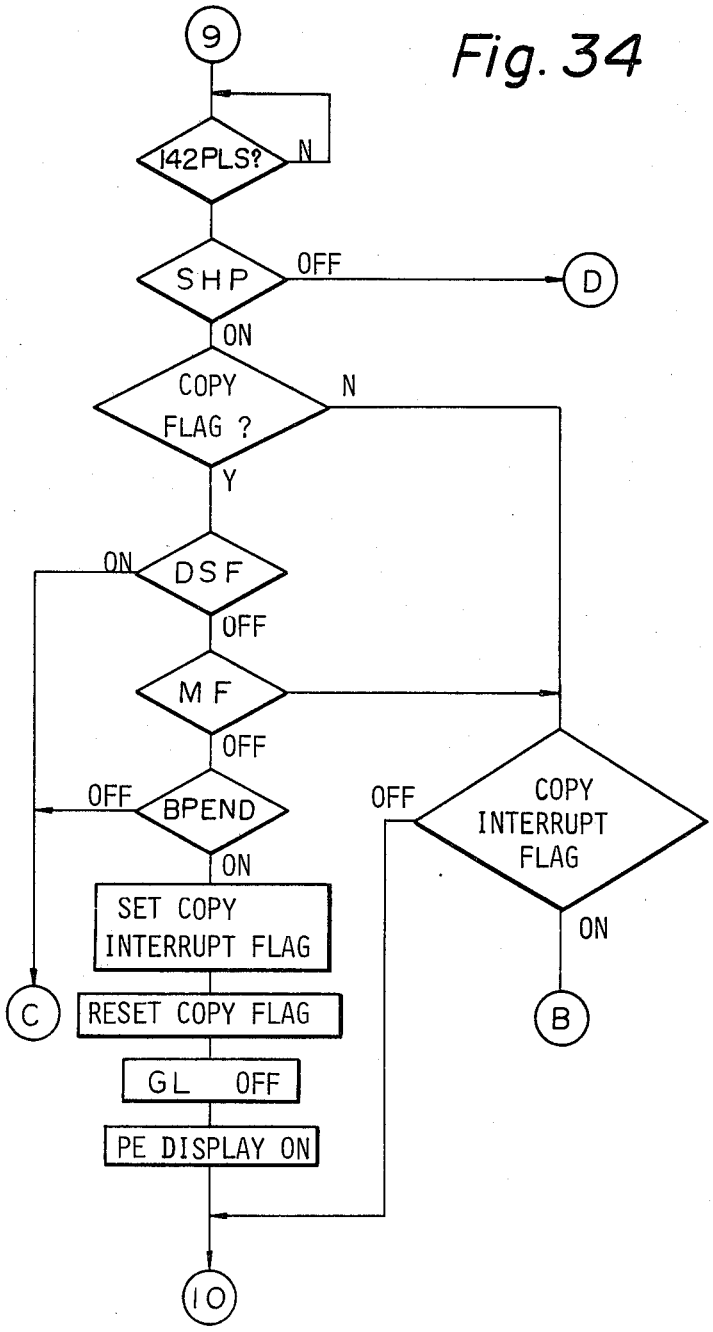
Figure 35:
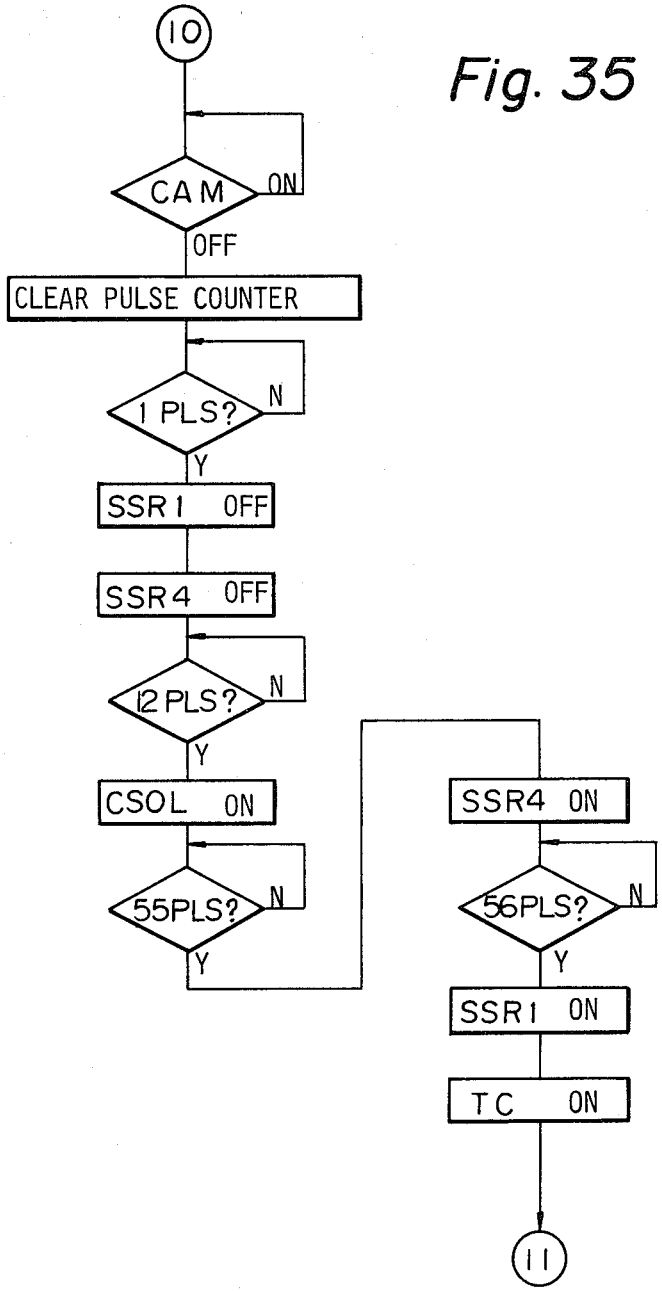
Figure 36:
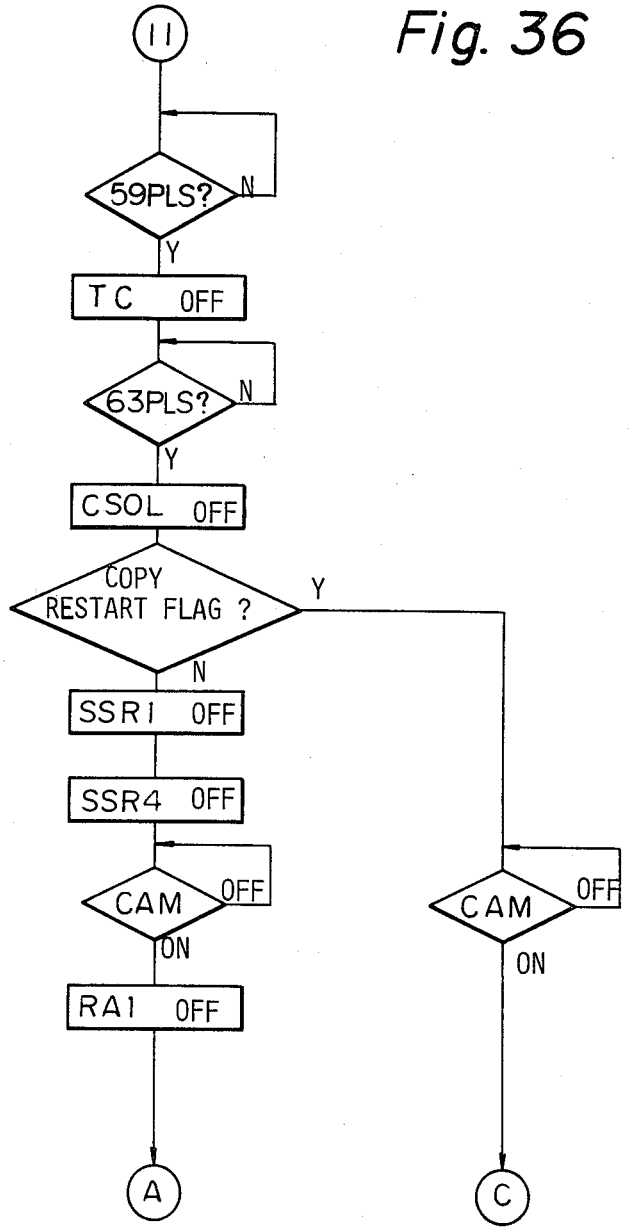
Figure 37:
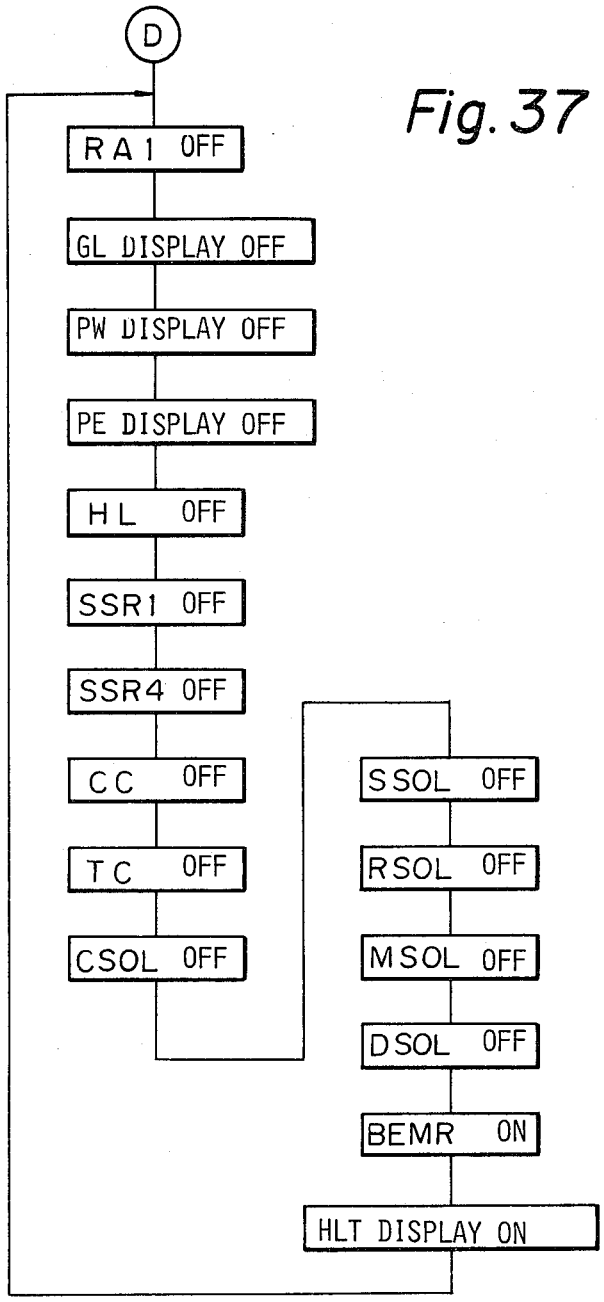
Figure 38:
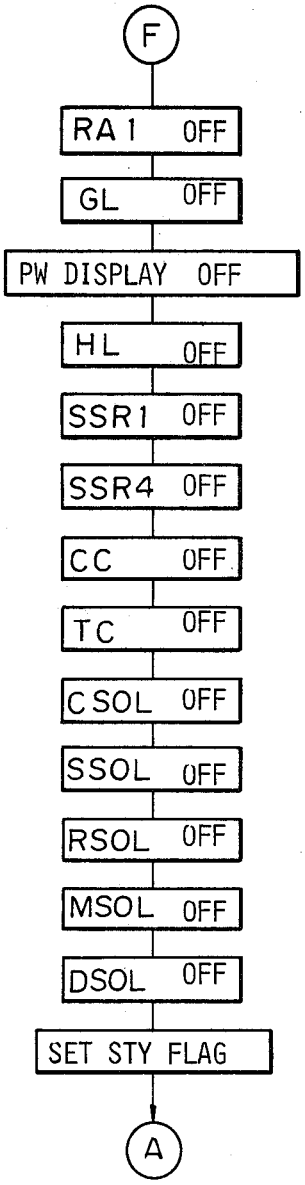
Figure 39:
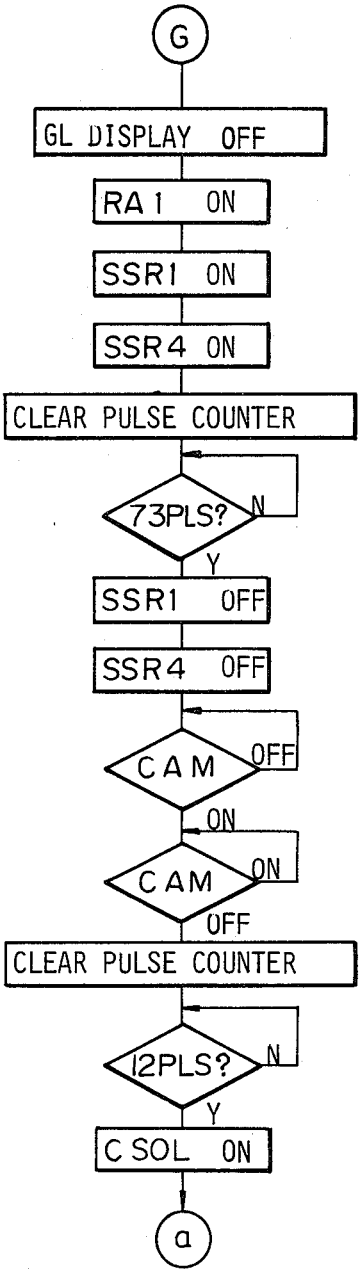
Figure 40:
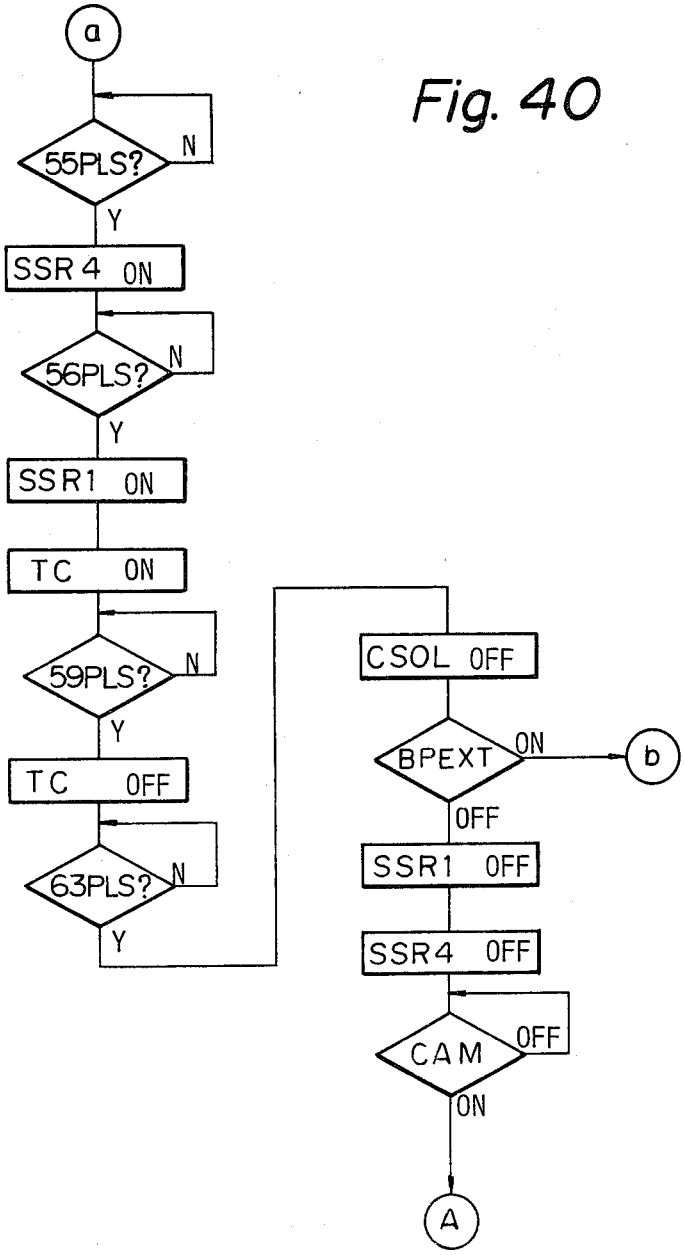
Figure 41:
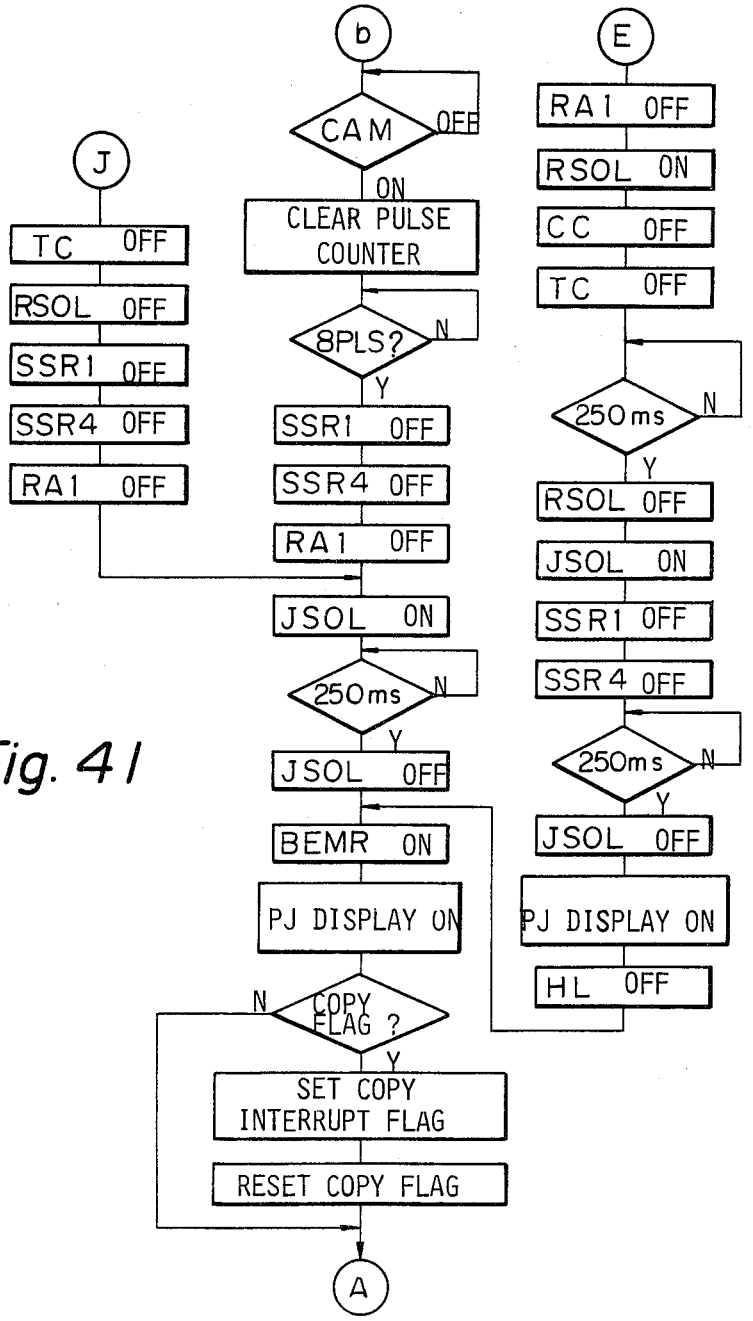
Figure 42:
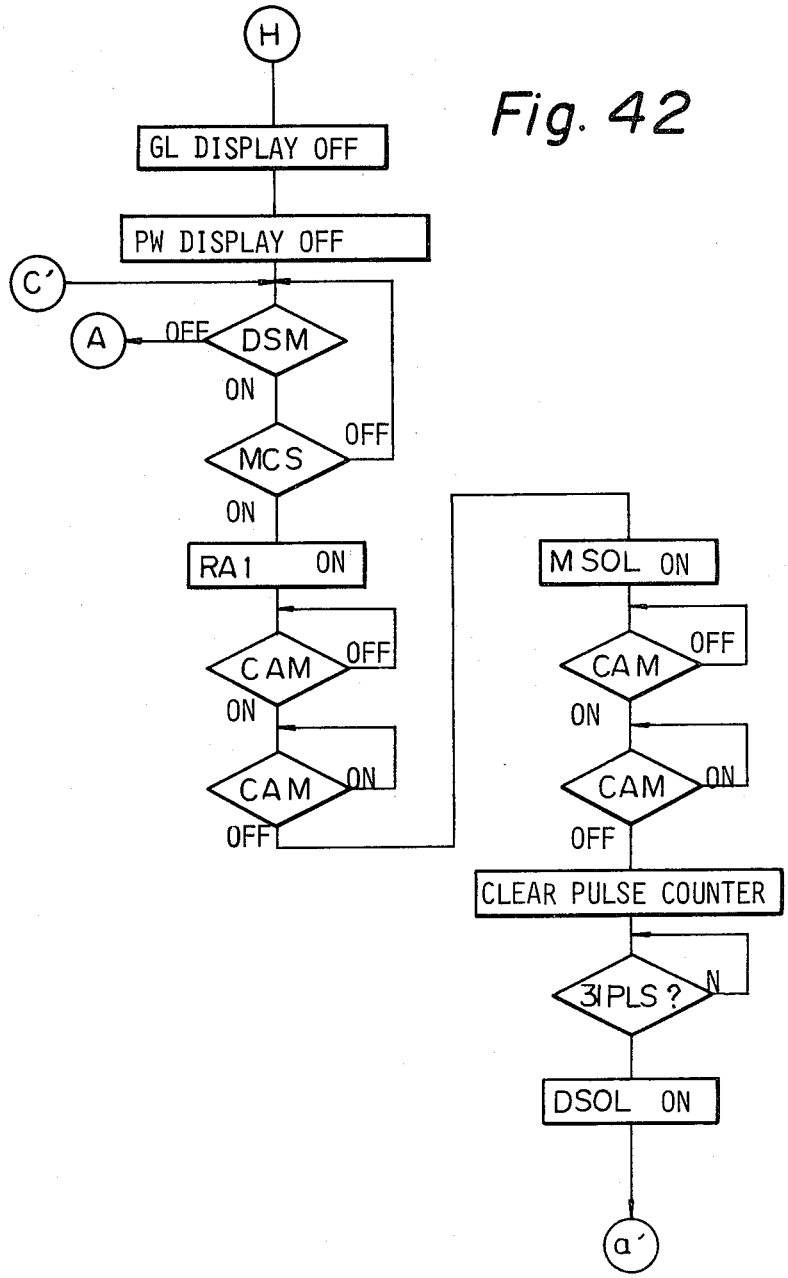
Figure 43:
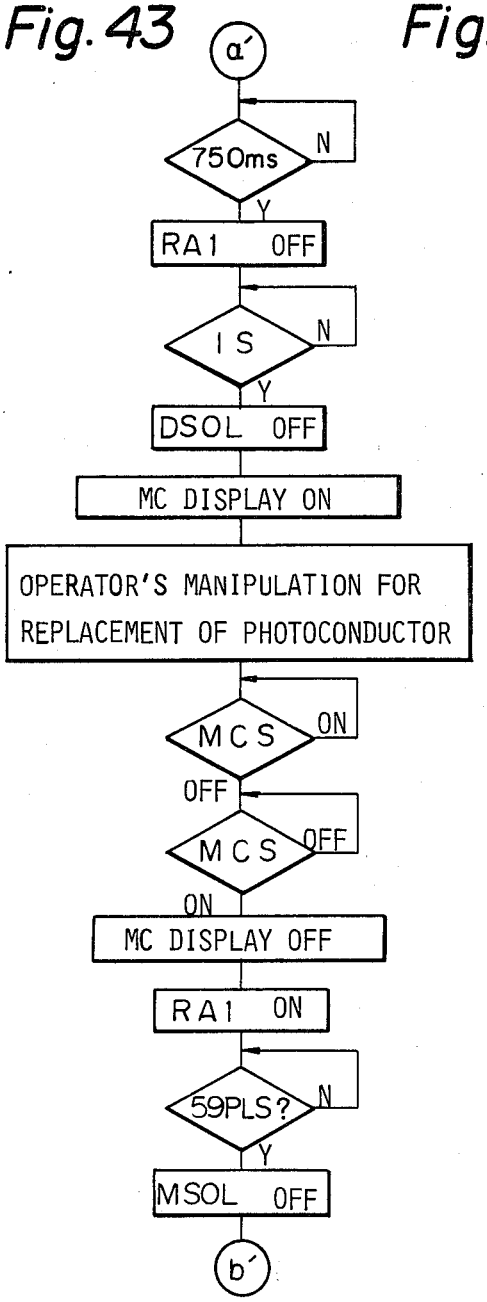
Figure 44:
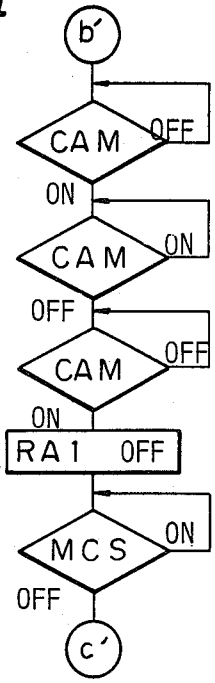

FIG. 12 shows the power source device 63 (see FIG. 6) adapted to prepare the voltage VA for the DC loads and the like. The voltage VA is processed by a circuitry shown in FIG. 13 to produce a voltage VDD. This voltage VDD constitutes a power source for the control circuit 65 which includes a microcomputer IC201 as indicated in FIG. 14. The control circuit 65 has in the periphery of the microcomputer IC201 a reset circuit (see FIG. 15(*a*)), a timing generation circuit (see FIG. 16), an input level conversion circuit (see FIGS. 19 and 20), a driver circuit (see FIG. 21) and the aforesaid voltage generation circuit VDD. The input device 64 (see FIG. 6) comprises a diode matrix circuit (see FIG. 17) and a photoelectric detection circuit (see FIG. 18). Signals input to and processed by the input level conversion circuit are coupled to terminals PA0–PA3, PB0–PB3. DC loads are commonly connected to the power source VA and to the driver circuit to be driven individually at predetermined timings. The display unit (see FIG. 22) is arranged on a control panel (see FIG. 24) for example; light emitting diodes are driven dynamically while tungsten lamps are driven directly.

Figure 16:
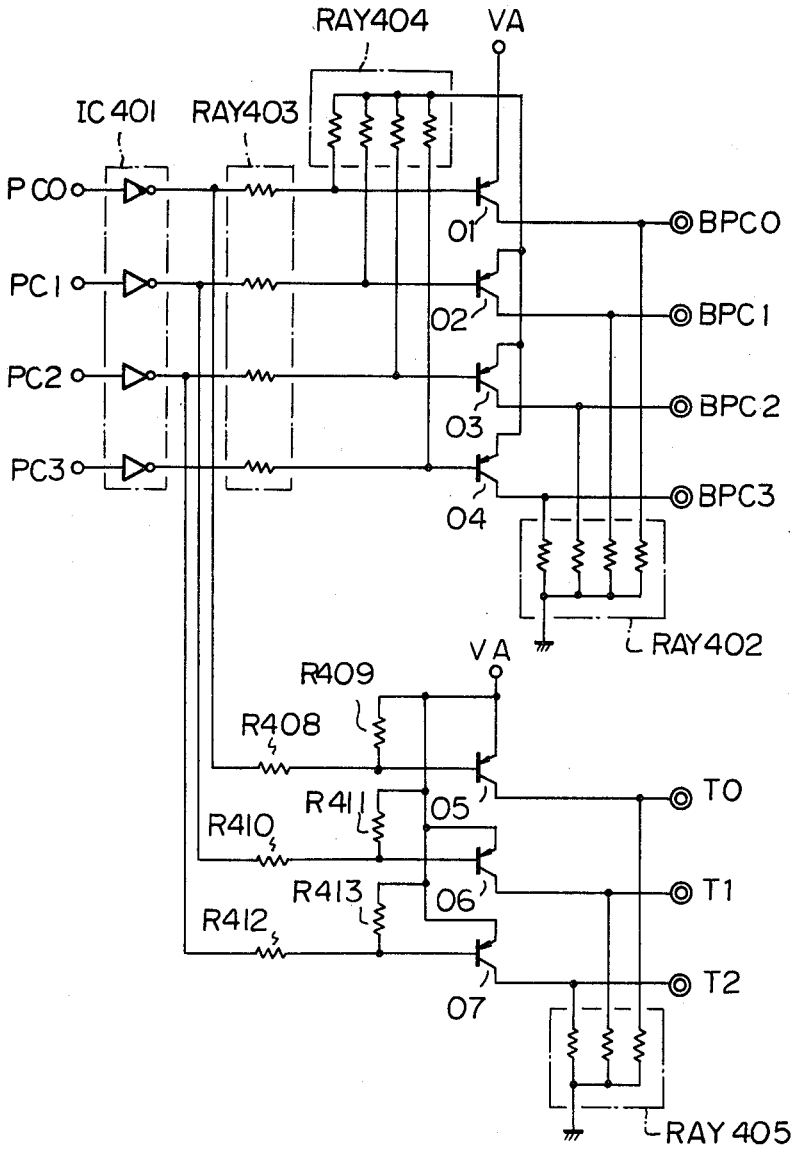
FIG. 16 is a diagram of a timing generation circuit of the present invention.
Figure 17:
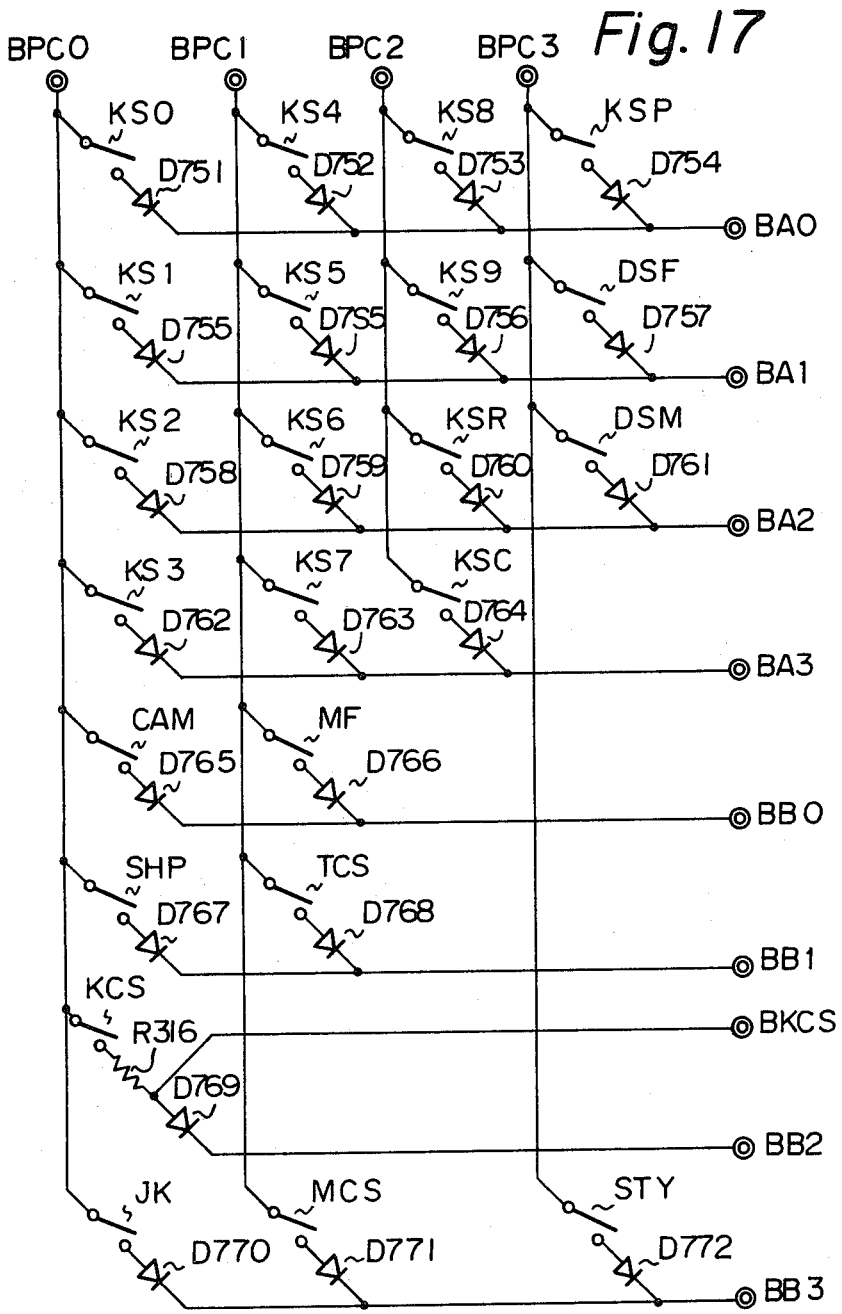
FIG. 17 is a diagram of a diode matrix circuit of the present invention.

The microcomputer IC201 has eight terminals PA0–PA3, PB0–PB3 as input ports, eight terminals PC0–PC3, PD0–PD3 as input/output ports, nineteen terminals PE0–PE3, PF0–PF3, PG0–PG3 and PI0–PI2 as output ports, and one terminal $\overline{INT}$ as an interruption port. The microcomputer IC201 has a reset terminal RES to which the initial reset circuit of FIG. 15(*a*) is connected. The terminal $\overline{INT}$ is connected with a wave shaping circuit of FIG. 15(*b*). The wave shaping circuit includes a comparator IC306-2 which is connected to a common reference voltage terminal REF (see FIG. 19) at its inverting input terminal and to a terminal BPG1 via a resistor R329 at its non-inverting input terminal. The terminal BPG1 is supplied with an output signal of the photoelectric detection circuit of FIG. 18. This signal input to the terminal BPG1 is synchronous with the rotation of the drum and has 72 successive pulses for each full rotation of the drum (one pulse corresponding to a 5° rotation). The input/output ports PC0–PC3 of the microcomputer IC201 are allotted to time division signals. As shown in FIG. 16, the time division signals PC0–PC3 are divided into signals BPC0–BPC3 and signals T0–T2 after level conversion. The signals BPC0–BPC3 are used as a reference signal for the diode matrix (see FIG. 17) while the signals T0–T2 are used as a reference voltage source (see FIG. 22) for the dynamic drive of the light emitting diodes LED.

Figure 18:
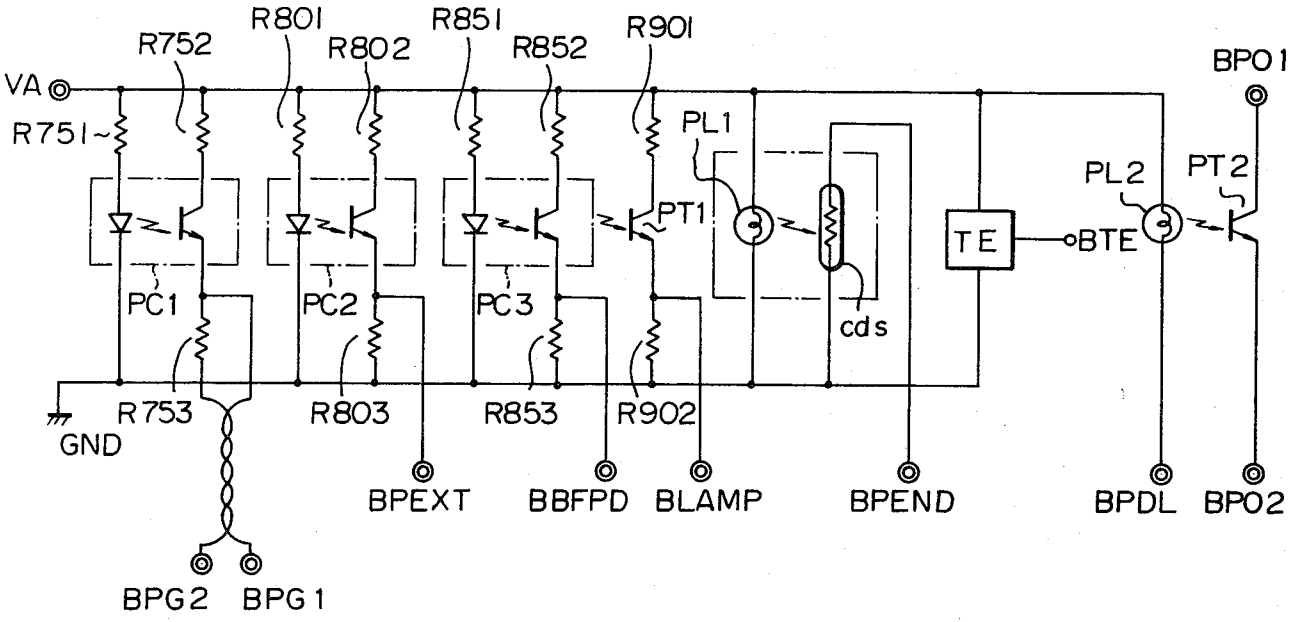
FIG. 18 is a diagram of a photoelectric detection circuit in accordance with the present invention.
Figure 19:
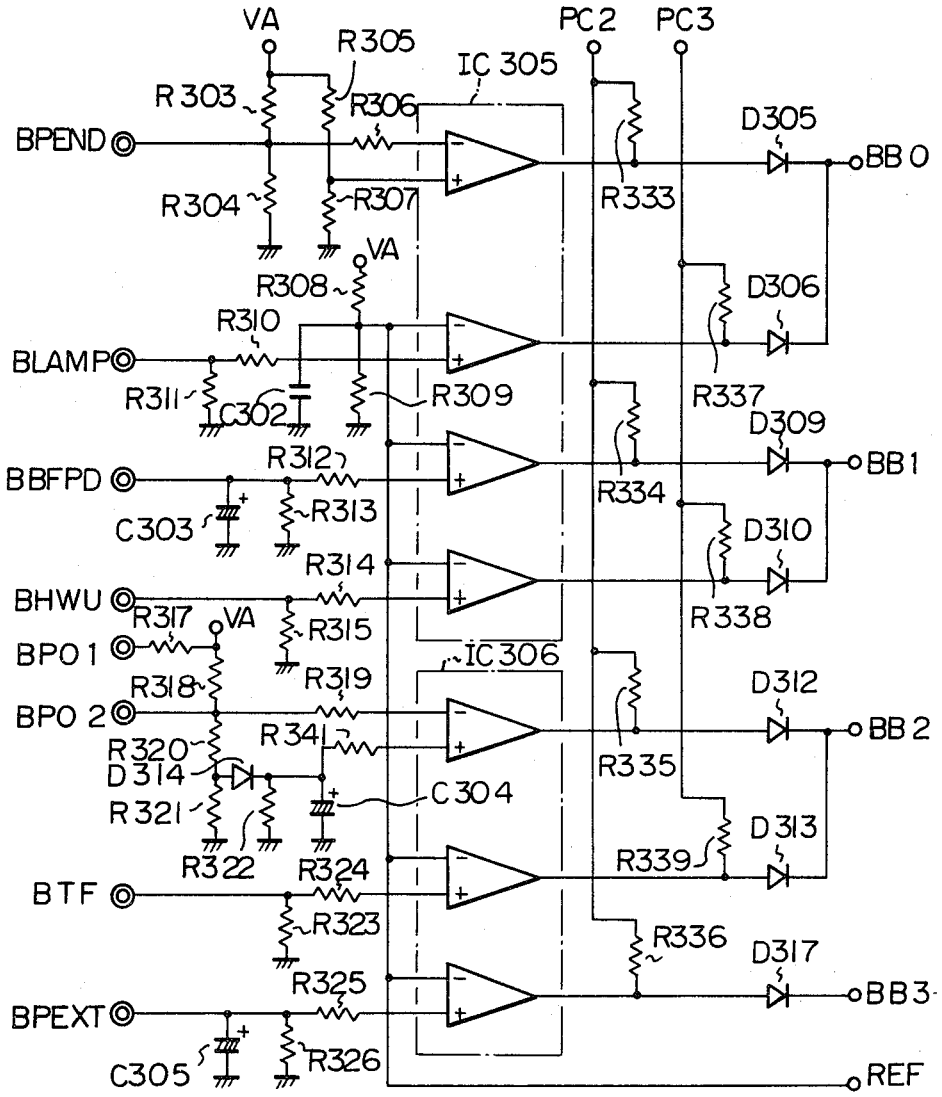
FIGS. 19 and 20 are diagrams of an input level conversion circuit of the present invention.
Figure 20:
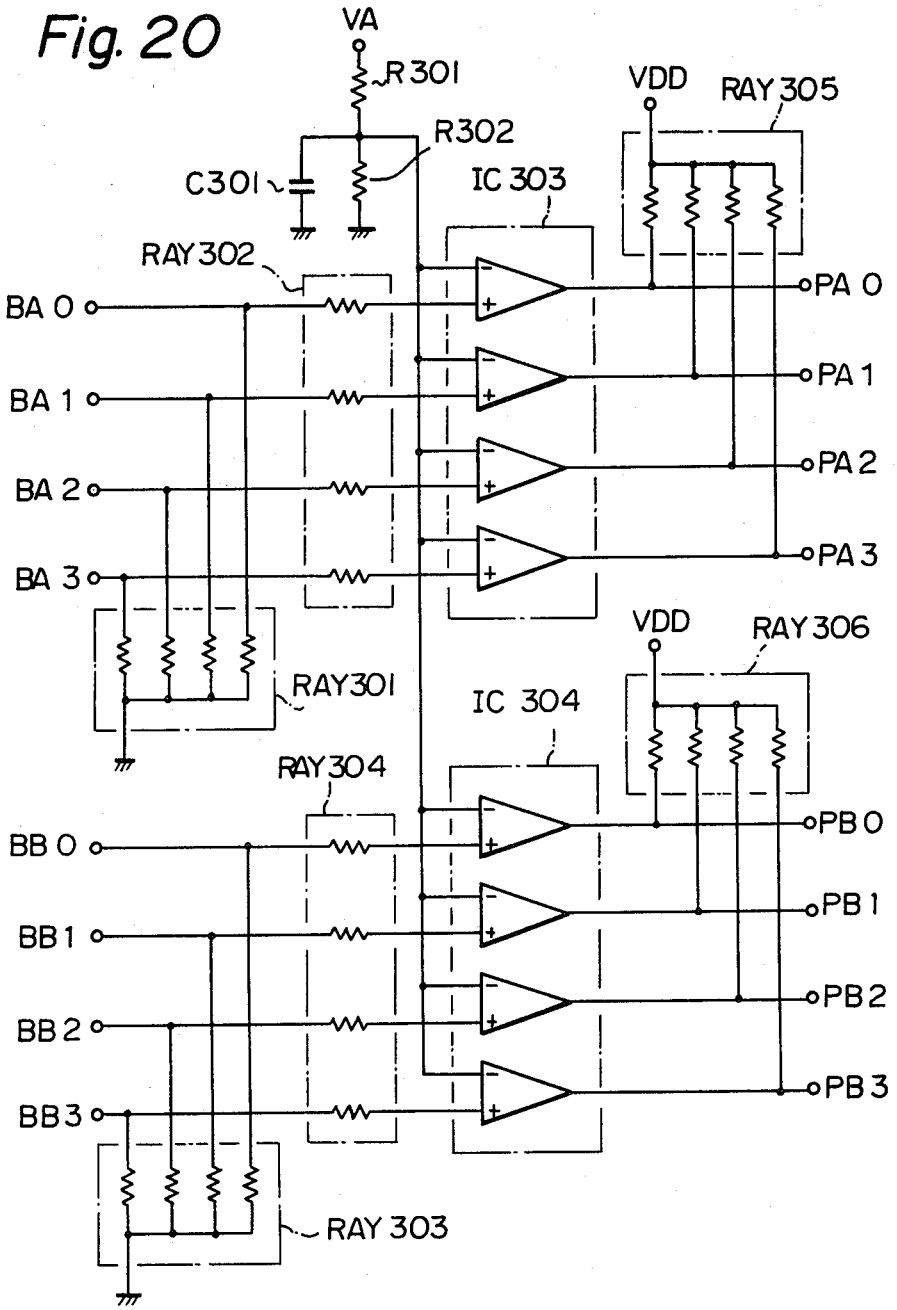

The input device 64 shown in FIG. 6 is constituted by the diode matrix (see FIG. 17) and the photoelectric detection circuit (see FIG. 18). The control panel (see FIG. 24) is provided with ten keys KS0–KS9, a print key KSP, a clear/stop key KSC and a key KSR for the confirmation of a numerical input through the ten keys KS0–KS9. The clear/stop key KSC is manipulatable to clear a numerical value input when the copier is inoperative or to interrupt a continuous copying operation. The confirmation key KSR functions to call up on the display CV the desired number of copies preset in a cassette mode during a continuous copying operation or an interruption for manual insertion. There are provided various control switches which are a drum home position switch SHP, a platen home position switch SHP, a jam memorizing switch JK, a key counter switch KCS, a manual feed door switch MF, a total counter switch TCS and a safety switch STY. A service man can selectively manipulate a free-run mode switch DSF, a photoconductor replacement mode switch DSM and a photoconductor replacement switch MSC. Further, the pulse generator BPG1, BPG2 is provided to generate control signals. BPG1 is a signal line and BPG2 is a GND line. Since this pulse generator constitutes a source of reference signal supply for the sequence, its leads connecting to the control circuit 65 are combined as a twisted pair to minimize the influence of noise. Other control signals employed are a cassette sheet detection signal BPEND, a manual sheet feed detection signal BBFPD, an abnormal lamp-on detection signal BLAMP, a sheet separation detection signal BP01, BP02, a sheet exit detection signal BPEXT and a toner end detection signal BTE. The control circuit 61 delivers a thermistor breakage signal BTF and a heater warm-up signal BHWV. The control signals mentioned are coupled to the level conversion circuit of FIG. 19 and then to a second level conversion circuit of FIG. 20 together with the output of the matrix circuit. Having the signal level changed from VA to VDD, the control signals are passed from the second level conversion circuit to the input ports PA0–PA3, PB0–PB3 of the microcomputer IC201.

Functions of the various signals will be briefly described. The jam memorizing switch JK is designed to hold when a jam solenoid is turned on as will be described. To cancel the hold condition, a reset button (not shown) will be depressed after lifting the cover 70 of FIG. 1 to its open position. The total counter switch TCS is built in the total counter TC to produce an on signal as the counter TC steps. The manual feed door switch MF is turned on when the door 28 for manual sheet insertion shown in FIG. 1 is opened. The safety switch STY is turned off when the cover 70 is opened and turned on when the same is closed. The free-run mode switch DSF and replacement mode switch DSM comprise dip switches which are selectively operated by a service man. When the free-run mode switch DSF is turned on, the copier can be operated without any supply of sheets. When the replacement mode switch DSM is turned on, the copying operation of the copier is inhibited and a replacement mode is established. When the replacement switch MCS is turned on in the replacement mode, the photoconductor 5 can be replaced with fresh one. The drum home position switch CAM corresponds in position to the leading end of an image carried on the photoconductor 5 and remains turned on through an angle of about 40° for one rotation of the drum. The cassette sheet detection signal BPEND produces a high or "H" level output when the sheet stack in the sheet cassette runs out. The manual sheet feed detection signal BPFPD produces a high or "H" level output when a sheet is inserted in a manual insertion mode. The abnormal lamp-on detection signal BLAMP produces a high or "H" level output when the halogen lamp is turned on. A lamp PL2 for the detection of sheet separation is disposed in the discharging lamp unit while a light receiving element PT2 is positioned between the upper and lower runs of the conveyor belt 30. The detecting surface of the light receiving element PT2 is cleaned by sucking scattered toner paricles and the like which might be deposited thereon by the charge on a paper sheet. The sheet separation detection signal BPO1, BPO2 is coupled to the interface circuit of FIG. 19. A capacitor C304 in the interface circuit stores for a given time period a signal input resulting from the passage of a paper sheet through the separation detecting station. This signal is delivered from the interface circuit after being identified by a comparator associated with the capacitor C304. With this arrangement, when the light source mentioned above fails to be energized, that is, when the discharging lamp unit is not positioned properly as after an operation for removing a sheet jam, an output common to that which represents a separation failure will appear and the sheet exit detection signal BPEXT which is also used for the detection of incomplete discharging lamp unit position will produce a high or "H" level output upon passage of a paper sheet through the sheet discharging device 34. The thermistor breakage signal BTF becomes high or "H" level when the thermistor is broken. The heater warm-up signal BHWU becomes high or "H" level upon elevation of the temperature of the heat roller 36 (see FIG. 6) to a predetermined level.

Figure 21:
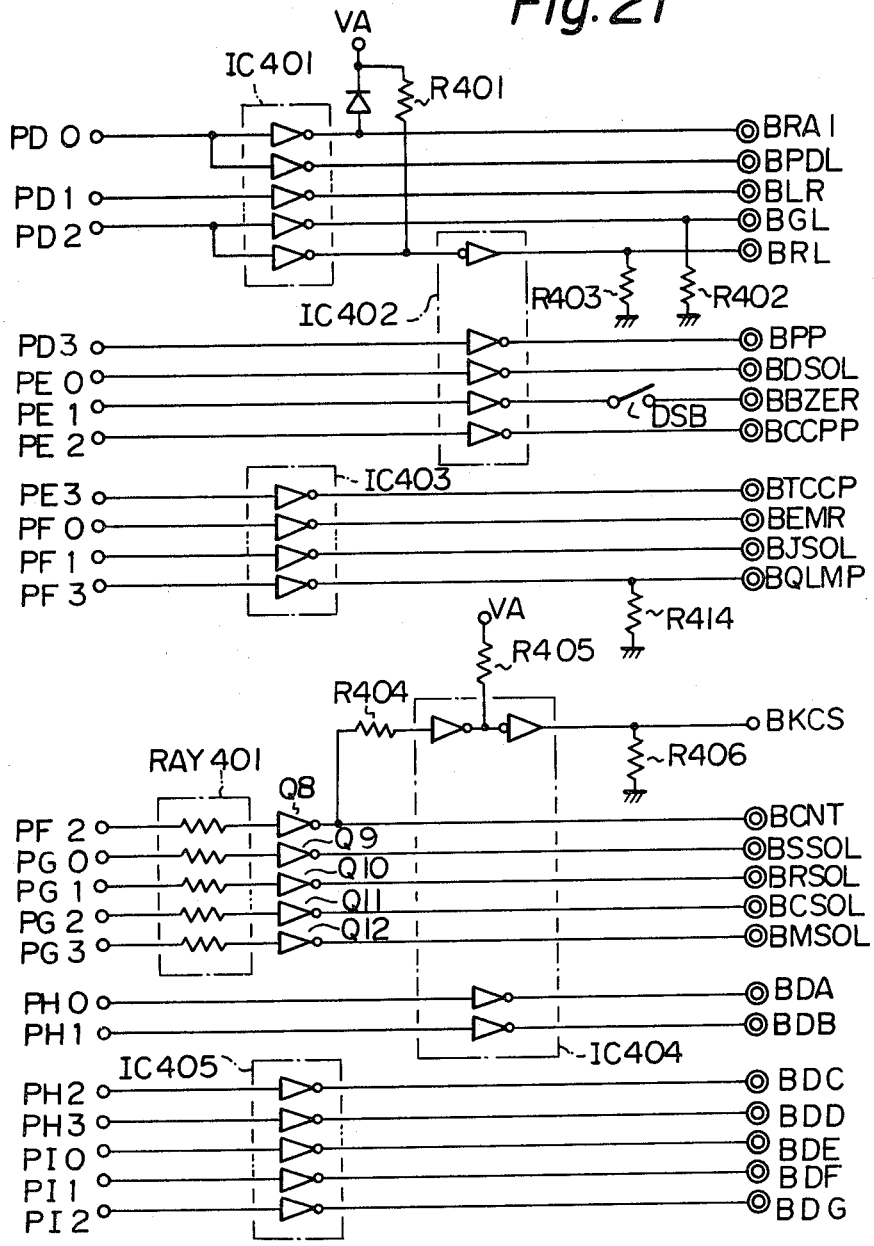
FIG. 21 is a diagram of a driver circuit of the present invention.
Figure 22:
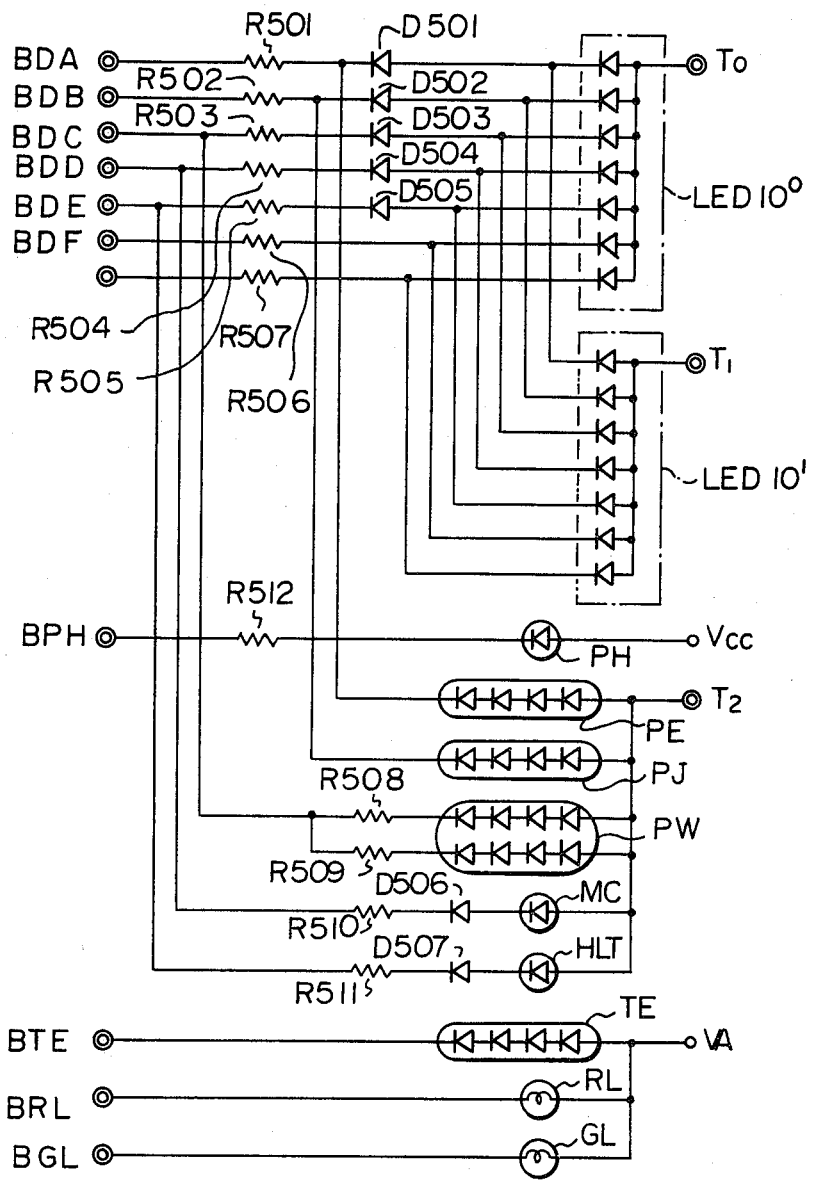
FIGS. 22 and 23 are diagrams of a diaplay device of the present invention.
Figure 23:
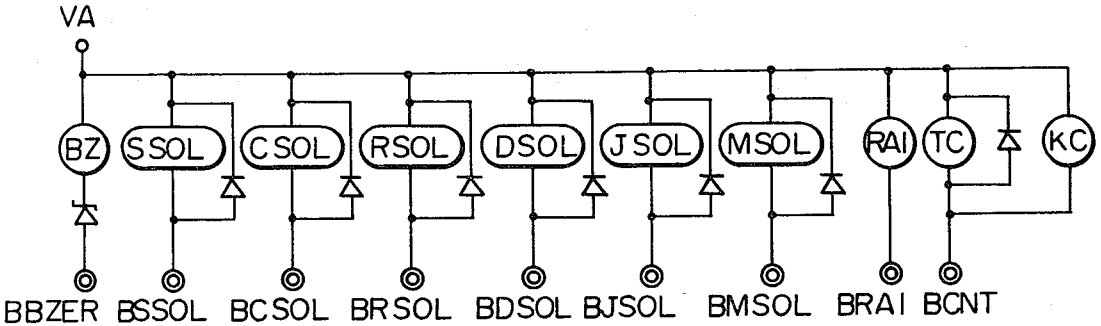

Referring to FIG. 21, the driver circuit comprises a set of drivers through which the outputs PD0–PD3, PE0–PE3, PF0–PF3, PH0–PH3 and PI0–PI2 of the microcomputer IC201 are passed to drive DC loads of solenoids (see FIG. 23) of the display unit (see FIG. 22). A buzzer BZ is energized if the key switches KS0–KS9, KSC and KSR are effective when the latter is turned on. The buzzer BZ is also energized when the heater is warmed up to a reload state. This buzzer BZ can be selectively turned on or off by a service man through an on-off switch DSB. A start solenoid SSOL is adapted to drive the platen 3 for a forward stroke. A cleaning solenoid CSOL drives the rotary brush 15 into contact with the photoconductive member 5 at the second rotation of two successive rotations of the drum 4. A return solenoid RSOL causes the platen 3 into a return stroke. A drum stop solenoid DSOL drives a drum stop cam clutch 56 (see FIG. 4). A jam solenoid JSOL drives the jam memorizing switch JK. A photoconductor replacement solenoid MSOL drives the trailing end clamper stop lever 71. The total counter TC is employed to store the number of copy sheets. The key counter KC is optionally usable. As viewed in FIG. 24, the display unit arranged on the control panel comprises a green lamp GL for indicating a copy enabled condition, a red lamp RL for indicating a copy ready condition, a "WAIT" sign PW indicating that the fixing unit is in a warm-up operation, a paper end display PE indicating absence of sheets, a jam display PJ indicating a sheet jam, a copy number display CV ($LED10^0$, $LED10^1$), and a toner end lamp TE indicating that the toner has run out. A display HTL is arranged on a printed circuit board which constitutes the control circuit 65, in order to indicate a failure of the copier. A display MC is employed to show that the used photoconductive member 5 has been discharged and new one is being loaded on the drum 4.

The green lamp GL and red lamp RL are so constructed that the red lamp RL is deenergized when the green lamp GL is energized and vice versa (see FIG. 21).

Figure 46:
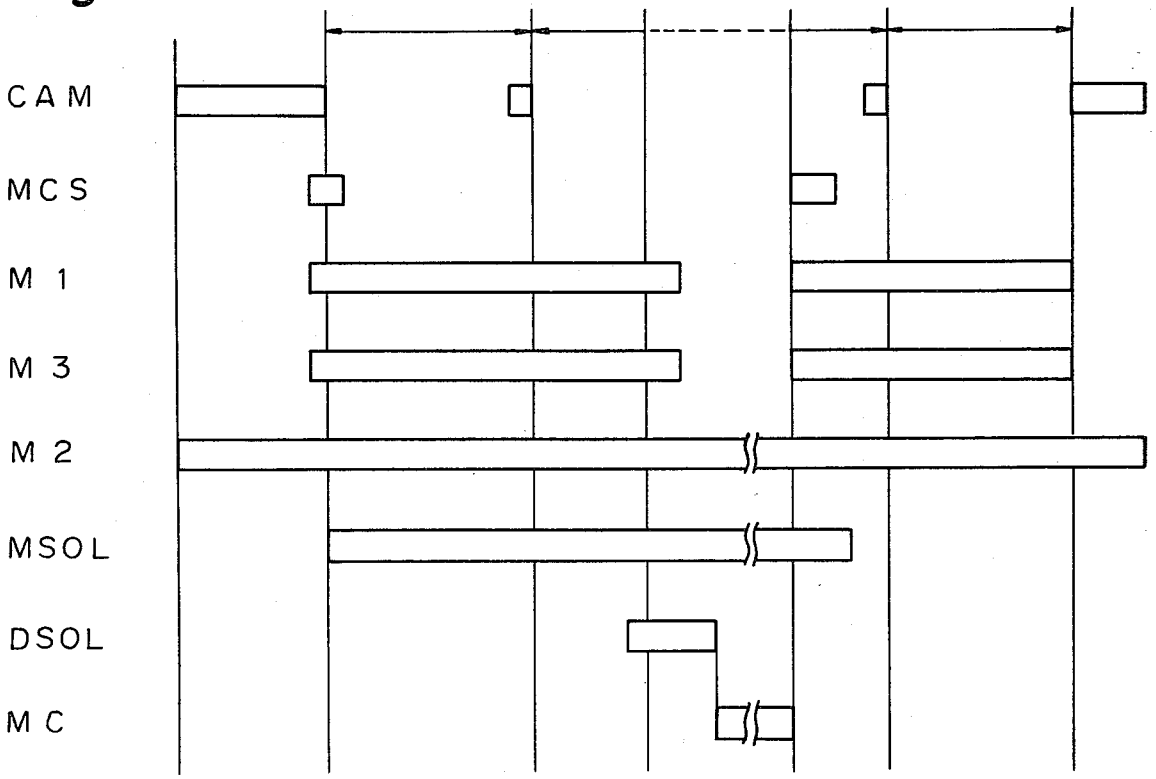
FIG. 46 is a timing chart showing a procedure for the replacement of a photoconductive member of the copying apparatus.

The copying apparatus thus constructed will be operated as described hereinafter with reference to the flowcharts of FIGS. 25–44 and the timing charts of FIGS. 46 and 47.

When the main switch MSW is turned on, the green lamp GL is energized if the thermistor failure detection signal BTF, lamp failure detection signal BLAMP, jam memorizing switch JK, safety switch STY, platen home position switch SHP, drum home position switch CAM, replacement mode switch DSM, heater warm-up signal BHWU, free-run switch DSF, manual feed door switch MF, cassette sheet detection signal BPEND and key counter switch KCS produce predetermined signals. If the thermistor failure signal BTF or lamp failure signal BLAMP is present, the procedure jumps to a flow (D) to inhibit actions of the loads and provide a failure display LED HLT while providing an emergency signal BEMR to inhibit the heater control. If the jam memorizing switch JK is in its on state, the operation jumps to a flow (E) to inhibit the actions of the loads while producing the emergency signal BEMR. If the safety switch STY is off, the operation jumps to a flow (F) to disenable the loads and set a safety flag. Under this condition, the operation goes from the flow (F) back to a flow (A) . If the safety switch STY is on in this flow A , the safety flag is checked and, if it is on, a 2-second timer is activated. After 2 seconds, the safety flag is turned off permitting the operation advance to he next step.

Suppose that the platen home position switch SHP or the drum home position switch CAM is off. Then, the operation jumps to a flow (G) in which the power relay RA1 is energized to drive the motor M1 and the fan M3 for cooling the optical system. The motor M1 drives the platen 3, drum 4, auxiliary cleaning unit 16, developing and cleaning unit 17, sheet feed device 27, fixing unit 33, sheet discharging device 34 etc. When the a.c. switching element SSR1 is turned on, the charger QC for discharging is energized through the high tension power source PP. When the a.c. switching element SSR4 is energized, the discharging lamp QL is energized. Thus, the residual charge removing device is activated for a period of time during which 73 pulses appear from the pulse generator PG ($5\times73=365°$). As the switch SHP or CAM is determined to be in its on state, the power relay RA1 is turned off. This stops the actions of the motor M1 and cooling fan M3. Unless the replacement mode switch DSM is turned off by a service man, the green lamp GL cannot be energized. This prevents the service man from forgetting such manipulation of the switch DSM.

When the heater warm-up signal BHWU is off, the "WAIT" sign PW is produced and the subsequent check is started. When the heater warm-up signal is on, the "WAIT" sign PW is turned off and the buzzer BZ is turned on. Upon the lapse of 100 milliseconds after the energization of the buzzer BZ, a buzzer flag is set and the buzzer BZ is deenergized. When turned on, the buzzer BZ informs the operator of the reload condition reached by the copier. The buzzer BZ can be selectively employed through a buzzer on-off switch DSB shown in FIG. 21.

When the manual feed door 28 is opened, the door switch MF is turned on so that "1" is set as a designated copy number and the sheet absent display PE is energized. As a paper sheet is manually inserted into the machine guided by the door or table 28, a manual sheet feed detection signal BBFPD is produced to turn off the sheet absent lamp PE and turn on the green lamp GL. An arrangement is made such that, if the manual feed copy flag is on while the door switch MF is checked, the number of copies provided by the manual insertion mode is displayed. The door switch MF is also designed to turn on if the sheet cassette is not positioned properly through the door 28 may be kept closed. Thus, the door switch MF bifunctions as a cassette position detector promoting efficient operation of the copier.

The desired number of copies can be set even when the green lamp GL is turned off. If the input through the ten keys is effective, the buzzer BZ is energized for 100 milliseconds. When the clear/stop switch KSC is turned on, the display is forcibly brought back to "1". The clear/stop switch KSC has priority to the ten keys KS0–KS9. As the clear/stop key KSC is depressed during successive copying cycles, the latter is interrupted. The clear/stop switch KSC also has priority to the print switch KSP; turning on the clear stop key first prevents a copying cycle from being started. Upon the lapse of 1 minute after manipulation of the ten keys KS0–KS9, the copy number display returns to "1". The 1-minute timer can be actuated only when the green lamp GL is turned on. However, the copy number display does not return to "1" though the green lamp GL may be turned on, if a copy interruption flag is turned on (as in the case where the paper sheets run out, a sheet jams or the clear/stop key KSC is turned on each during a continuous copying operation as will be described). When the free-run switch DSF is turned on, the copying apparatus can be operated without the supply of sheets to facilitate an operation check in the assembly stages.

Figures 45, 45A:
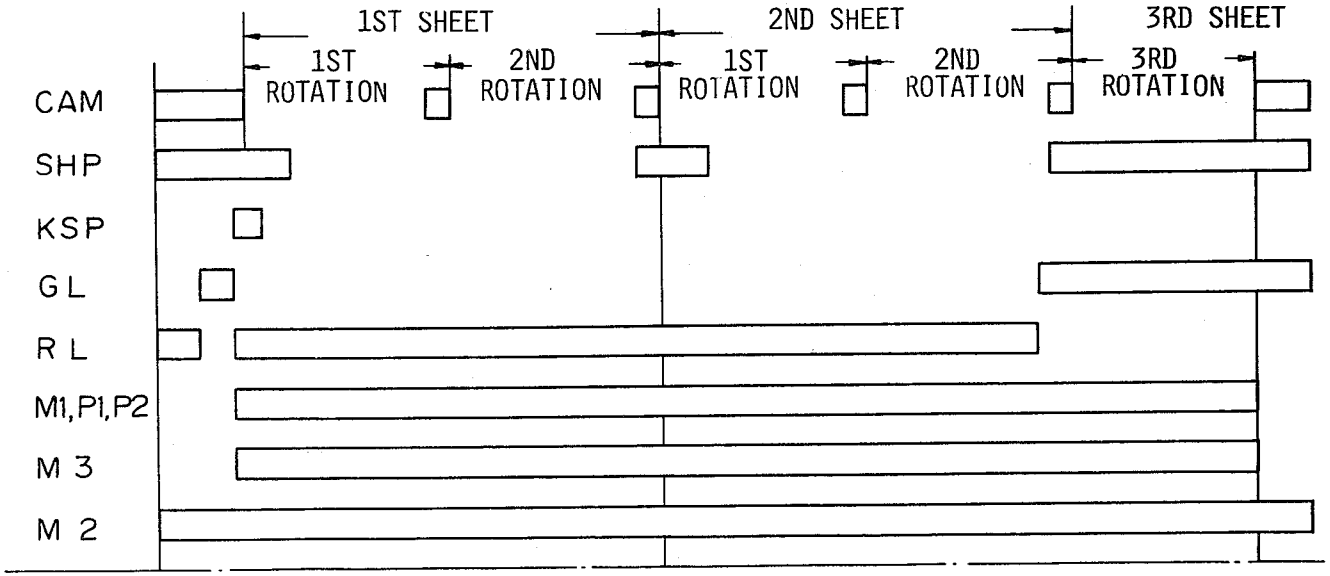
FIG. 45*a* and 45*b* comprise a timing chart showing the copy control.
Figure 45B:
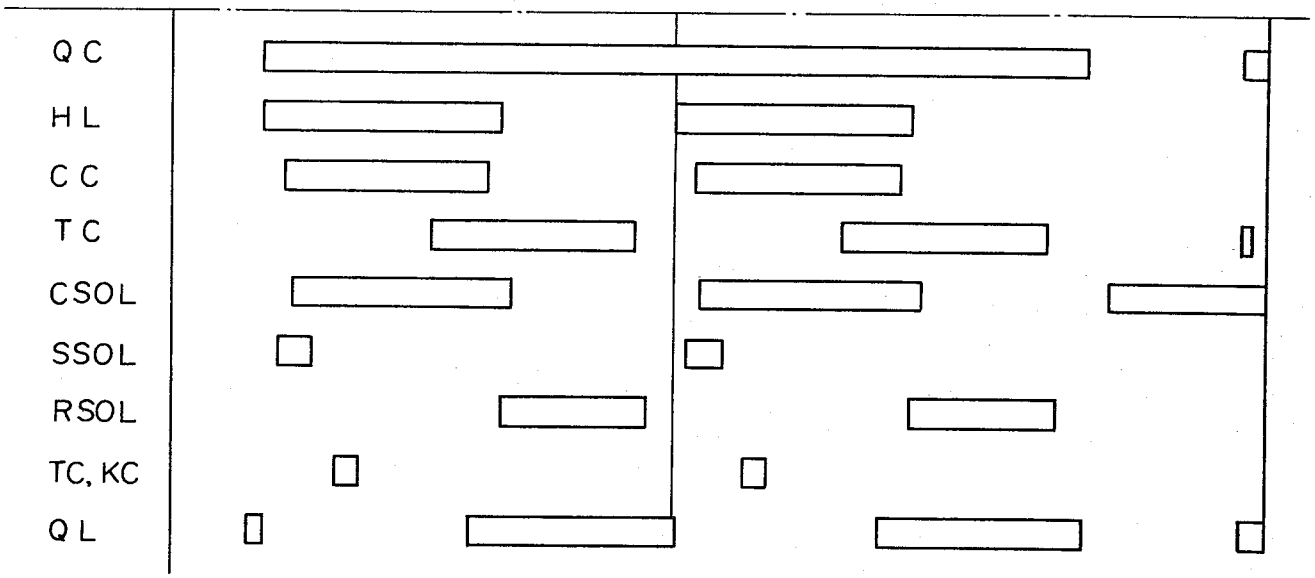

When the print switch KSP is turned on after the preparatory procedure discussed above, the power relay RA1 and a.c. switching element SSR4 are turned on to set a copy flag which memorizes a copying cycle. At the same time, the green lamp GL is turned off. The copy number display counter CV displays a preset copy number before a copying cycle and, after the print switch KSP has been turned on, it once displays "0" and then progressively upcounts. In a manual insertion mode, the counter CV once displays "0" and, as one copy sheet is completed, displays "1" while setting a manual insertion copy flag. Thereafter, every time the copying cycle is repeated with the door 28 kept open, the counter CV is incremented by one. When the door 28 is closed, the manual insertion copy flag is reset while a memory for the manual insertion mode copy number is reset. If a copy interruption flag is on during a cassette mode operation, the counter CV is incremented one by one from the existing copy number. The drum home position switch CAM is positioned to turn off at the leading end of the photoconductive member 5 of FIG. 1. At the instant the switch CAM is turned off, a pulse counter for counting output pulses of the pulse generator PG is reset and the first of two successive drum rotations for a copying cycle is initiated. After the a.c. switching element SSR1 has been turned on to energize the halogen lamp HL, the pulse counter counts one pulse (5°) and then turns off the a.c. switching element SSR4. Thereafter, the start solenoid SSOL is energized to move the platen 3 for a forward stroke. At the 9th pulse, the charger CC is energized. At the 12th pulse, the cleaning solenoid CSOL is energized to move the cleaning brush 15 clear of the photoconductive member 5. At the 30th pulse, the forward stroke of the platen 3 is checked and, if it is normal, the platen home position switch SHP remains turned off and an electromagnetic counter CNT is turned on. If the platen 3 does not stroke forward, the platen home position switch SHP remains turned on and the operation jumps to the normalizing flow (D) . The counter CNT has therein the switch TCS which operates at the instant when the counter CNT steps. Before stepping of the counter CNT, the off state of the switch TCS is checked; immediately before the counter CNT is turned off, the on state of the switch TCS is checked. If the state of the switch TCS is abnormal, the copy interruption flag is set and a continuous copying operation is inhibited. At the 59th pulse, the transfer charger TC is energized. At the 72nd pulse, the drum 4 completes the first rotation and enters the second rotation. At the 73rd pulse, the a.c. switching element SSR4 is turned on. At the 76th pulse, the sheet separation detection signal BPO is checked. When a paper sheet is safely separated from the photoconductor 5, light emitted from the lamp PL2 (lamp 32 in FIG. 1) is intercepted by the paper sheet so that the signal BPO remains in the on state for a given period of time. When the sheet separation is incomplete, the signal BPO remains in the off state and the procedure jumps to the jamp removing flow (E). At the 81st pulse, the charger CC is turned off. At the 85th pulse, the halogen lamp HL is deenergized and the return solenoid RSOL is turned on to cause the platen 3 into a return stroke. At the 92nd pulse, the cleaning solenoid CSOL is deenergized to bring the brush 15 into contact with the photoconductor 5 to clean its surface and the sheet exit detection signal BPEXT is checked. At this instant, the paper sheet has not yet reached the position of the discharging device 34 so that the signal BPEXT is off. If the preceding copy sheet has jammed the discharging device 34 without being fully discharged, the signal BPEXT is on and the operation jumps to a jam removing flow (J). At the 128th pulse, the signal BPEXT is rechecked. If the copy sheet has reached the discharging device 34, the signal BPEXT is on and the copy number display is incremented by one. If the copy sheet has jammed in a position ahead of the discharging device 34, the signal BPEXT is off; at the 143rd pulse, the operation advances to the jam removing flow (J). At the 131st pulse, the transfer charger TC is deenergized. As the number of copies obtained coincides with the set number, the copy flag is reset and, even in the course of a copying cycle, the green lamp GL is energized to permit entry of the next desired copy number. Even though the set and actual copy numbers may be out of coincidence, the copy flag is reset to interrupt the copying operation if the copy interruption flag is turned on. In a manual insertion mode, the door switch MF is turned on so that the sheet absent display PE is activated and the copy flag is reset. At the 142nd pulse (immediately before the drum completes the second rotation), the return stroke of the platen 3 is checked. If the platen 3 is in the home position, the home position signal SHP is turned on; if not, the signal SHP is turned off and the operation jumps to the normalizing flow (D). Then, the copy flag is checked. If the copy flag is not set, the operation jumps to a flow (C) in which a copying cycle created by two successive rotations of the drum is repeated until the copy flag becomes reset. If the copy flag is reset, the off state of the drum home position switch CAM is confirmed and the drum enters the final rotation to convey a paper sheet to the tray 35. The on state of the drum home position switch CAM is confirmed whereupon the power relay RA1 is deenergized to deactivate the whole machine. If the print switch KSP is turned on after the check of the copy flag and before the drum home position switch CAM is turned off, the system does not cause the drum into the final rotation but jumps to a flow (B) to resume a copying cycle. FIG. 45 is a timing chart in which two copy sheets are provided by the copier successively.

Apart from the copying program discussed hereinabove, an XINPT routine is performed, though not shown, during a period for waiting for a pulse or closing or opening of the drum home position switch CAM. In this routine, various input signals are read in, time division signals are produced for so reading input signals and driving the light emitting diodes LED, and various timers are actuated. Supposing that the clear/stop key has been despressed during a copying cycle, the copy interruption flag is set, a copy sheet is fully discharged, the copy number of that instant is displayed and the system is deactivated to await the next key input. Subsequently, when the print switch KSP is turned on again, a copying cycle is repeated until the copy number existed at the instant interruption increases to the set copy number. When the door 28 is opened in the course of a copying cycle, the door switch MF is turned on to set the copy interruption flag so that the copy number in the cassette mode is stored in a memory and the display is returned to "1" and, then, the machine is deactivated. This may be followed by a manual insertion mode of operation or by another cassette mode of operation which is established by closing the door 28. In this case, the copy number display counter reads out the data stored in the memory to display it again. Turning on the print switch KSP in this condition causes the copier to stop after producing a designated number of copies as already described. Hereinafter will be described an emergency stop of the copying apparatus.

At the 30th pulse, the forward stroke of the platen 3 is checked and, if it is abnormal, the system jumps to the flow (D) in which the power relay RA1 and the like are deenergized to turn off the green lamp GL. At this moment, the leading end of the photoconductor 5 has stopped at an angle of about 170° which is the sum of 150° (5°×30=150°) and approximate 20° attributable to the inertia of the drum, so that the drum home position switch CAM is off. Thus, when a service man turns on the power source after repairing the machine, the system enters the previously described positioning routine whereby the photoconductor 5 is cleaned. At the 76th pulse, sheet separation is checked and, if it is abnormal, the flow (E) is practiced in which the return solenoid RSOL is turned on, the charger CC and transfer charger TC are deenergized, and the power relay RA1 is deenergized. Thereafter, the jam keep solenoid JSOL is energized to activate the jam display PJ while turning on the jam memorizing switch JK. By a mechanical latch arrangement, the switch JK is kept turned on until an operator resets it even though the jam keep solenoid JSOL may be turned off. By the very mechanical nature, the switch JK can be reset even if the main switch is turned off. At this instant, since the platen 3 has neither returned to the home position, the platen home position switch SHP is also off. Likewise, in the event of a failure in the sheet discharge determined at the 92nd and 128th pulses or a failure in the forward stroke of the platen 3 determined at the 142nd pulse, the machine is stopped when the drum home position switch CAM or the platen home position switch SHP is turned off.

In all of the failures mentioned, an emergency output BEMR is turned on which prevents the a.c. switching element SSR3 for the heater from being driven.

When the photoconductor replacement mode switch DSM is turned on, the system jumps to a flow (H) in which the green lamp GL is turned off to inhibit a copying operation while the "WAIT" sign disappears. As the replacement start switch MCS is turned on, the power relay RA1 is energized and the drum home position switch CAM is turned off. This initiates a photoconductor discharge as a part of a replacement cycle and turns on the replacement solenoid MSOL. During the second rotation of the drum 4, the drum stop solenoid DSOL is energized and the power relay is deenergized after 750 milliseconds by the timer. After 1 second, the drum stop solenoid DSOL is deenergized by the timer to complete the discharge of the photoconductor 5 activating the photoconductor supply display MC. When a new photoconductor 5 is loaded on the drum 4 after the removal of the old one and the replacement start switch MCS is again turned on, the power relay RA1 is energized to permit the new photoconductor to be wound on the drum 4. Afterwards, the replacement solenoid MSOL is deenergized, the drum home position switch CAM is checked, and the power relay RA1 is deenergized to complete the photoconductor supply. The system advances to the next step after confirming that the replacement start switch MCS has been turned off. This prevents a discharging operation from being immediately followed by a charging operation or vice versa when the used photoconductor is discharged or the fresh one is charged, even if the replacement start switch MCS is kept in its on state. FIG. 46 is a timing chart demonstrating the replacement of the photoconductor 5.

In summary, it will be seen that the present invention provides an improved copying apparatus which can hold a designated or set number of copies and operate with an increased efficiency. This is because a desired copy number can be input even in a stand-by period after the turn-on of a main switch and because a timer is activated only after a second display unit displays a copy enabled condition.

Various modifications will become possible for those skilled in the art after receiving the teachings of the present disclosure without departing from the scope thereof.

What is claimed is:

1. Electrophotographic copying apparatus comprising:

copy number input means for the desired number of copies of an original document;

first display means for indicating the set number;

second display means for indicating a copy ready condition in which the apparatus is ready to perform a copying operation;

copy starter means for commanding a start of the copying operation;

timer means for controlling the first display means to automatically return the set number of copies to one if the copy starter means fails to command the start of a copying operation during a predetermined period of time after the number of copies is set by the copy number input means; and control means for controlling the copy number input means to permit the same to set the number of copies even during a period for which the apparatus stands ready to perform the copying operation.

2. Apparatus as claimed in claim 1, in which said control means controls the timer means to actuate the same immediately after the copy ready condition is indicated by the second display means.

3. Apparatus as claimed in claim 1, further comprising manual copy sheet feed means, the control means being constructed to disable the copy number input means to set the number of copies while the manual copy sheet feed means is operative.

4. Apparatus as claimed in claim 3, in which said control means further controls the first display means to indicate one when the manual copy sheet feed means is activated.

5. Apparatus as claimed in claim 3, in which said control means further controls the first display means and timer means such that the manual copy sheet feed means is actuated, the first display means replaces the set number of copies with one, and the timer means is deactivated.

6. Apparatus as claimed in claim 4, in which said control means is further constructed to store the set number of copies and, when the manual copy sheet feed means is deactivated again, to control the first display means to indicate the set number of copies again.

* * * * *

Notice of Adverse Decision in Interference

In Interference No. 101,431, involving Patent No. 4,391,508, M. Shibusawa and T. Ogawa, COUNTER AND TIMING MECHANISM FOR COPYING APPARATUS, final judgment adverse to the patentees was rendered Dec. 19, 1985, as to claims 1-6.

[*Official Gazette February 11, 1986.*]